US011578502B2

(12) United States Patent
Naylor

(10) Patent No.: US 11,578,502 B2
(45) Date of Patent: Feb. 14, 2023

(54) FENCING

(71) Applicant: BJA Trading Ltd, Buckinghamshire (GB)

(72) Inventor: Mark Anthony Naylor, Cheshire (GB)

(73) Assignee: BJA Trading Ltd, Buckinghamshire (GB)

( * ) Notice: Subject to any disclaimer, the term of this patent is extended or adjusted under 35 U.S.C. 154(b) by 65 days.

(21) Appl. No.: 16/968,479

(22) PCT Filed: Feb. 8, 2019

(86) PCT No.: PCT/GB2019/050347

§ 371 (c)(1),
(2) Date: Aug. 7, 2020

(87) PCT Pub. No.: WO2019/155229

PCT Pub. Date: Aug. 15, 2019

(65) Prior Publication Data

US 2020/0399925 A1 Dec. 24, 2020

(30) Foreign Application Priority Data

| | | |
|---|---|---|
| Feb. 9, 2018 | (GB) | 1802175 |
| Jul. 20, 2018 | (GB) | 1811865 |
| Oct. 16, 2018 | (GB) | 1816828 |

(51) Int. Cl.
*E04H 17/16* (2006.01)

(52) U.S. Cl.
CPC ..... *E04H 17/168* (2013.01); *E04H 17/166* (2013.01)

(58) Field of Classification Search
CPC . E04H 17/14; E04H 17/1447; E04H 17/1473; E04H 17/1488; E04H 17/16;
(Continued)

(56) References Cited

U.S. PATENT DOCUMENTS

| | | | |
|---|---|---|---|
| 2,517,386 A | 8/1950 | Cooper | |
| 4,007,919 A | 2/1977 | Totten | |

(Continued)

FOREIGN PATENT DOCUMENTS

| | | | |
|---|---|---|---|
| CA | 2806405 A1 | 8/2013 | |
| DE | 2551637 A1 * | 6/1977 | ..... A01K 3/00 |

(Continued)

OTHER PUBLICATIONS

Search Report dated Jul. 30, 2018 in connection with United Kingdom Application No. GB1802175.8, 18 pages.

(Continued)

*Primary Examiner* — Jonathan P Masinick

(57) ABSTRACT

A panel-post connector plate 16 for connecting a fence post 12 to an adjacent fence panel 14. The panel-post connector plate 16 comprises a plate body 84 having a post-receiving aperture 86 for receiving at least part of the fence post 12 therethrough, and a fastener receiving aperture 92 for receiving a fastener to attach the plate body 84 to a panel-body of the adjacent fence panel 14. A header-rail engagement member 94 is at or adjacent to the plate body 84, the header-rail engagement member 94 receivable in the header rail 26 of the adjacent fence panel 14. A temporary rail support device, a gravel-board retaining element, a fence post and a fence are also described.

16 Claims, 26 Drawing Sheets

(58) Field of Classification Search
CPC . E04H 17/1602; E04H 17/163; E04H 17/165; E04H 17/168; E04H 17/17; E04H 17/20
See application file for complete search history.

(56) References Cited

U.S. PATENT DOCUMENTS

| | | | | |
|---|---|---|---|---|
| 4,193,584 | A | 3/1980 | Wieser | |
| 4,239,414 | A | 12/1980 | Williamson | |
| 5,275,382 | A | 1/1994 | Charbaut et al. | |
| 5,443,244 | A | 8/1995 | Gibbs | |
| 5,702,090 | A | 12/1997 | Edgman | |
| 6,173,945 | B1 | 1/2001 | Lindsey et al. | |
| 6,530,561 | B2 | 3/2003 | Larsen et al. | |
| 6,745,537 | B1 | 6/2004 | Hamilton | |
| 6,874,767 | B1 | 4/2005 | Gibbs | |
| 7,441,751 | B1 | 10/2008 | Gibbs | |
| 7,475,868 | B1 | 1/2009 | Gibbs | |
| 7,651,073 | B1 | 1/2010 | Gibbs | |
| 8,720,866 | B1 | 5/2014 | Gibbs | |
| 9,334,672 | B1 * | 5/2016 | Mallory | E04H 17/1447 |
| D836,799 | S | 12/2018 | Flusche et al. | |
| 2002/0067959 | A1 | 6/2002 | Thornton | |
| 2005/0116212 | A1 | 6/2005 | Deeley | |
| 2008/0163569 | A1 | 7/2008 | Woodard | |
| 2010/0223866 | A1 * | 9/2010 | Melville | A01K 3/00 52/282.1 |
| 2016/0145893 | A1 | 5/2016 | Coulston et al. | |
| 2018/0371789 | A1 * | 12/2018 | Moore | E04H 17/20 |

FOREIGN PATENT DOCUMENTS

| | | | | |
|---|---|---|---|---|
| DE | 29915580 | U1 * | 1/2000 | E04H 17/163 |
| EP | 0596825 | A1 | 5/1994 | |
| EP | 0649954 | A1 | 4/1995 | |
| EP | 0935038 | A1 | 8/1999 | |
| EP | 2055866 | A1 * | 5/2009 | E04H 17/006 |
| EP | 2226451 | A1 | 9/2010 | |
| EP | 2290174 | A1 | 3/2011 | |
| FR | 2102961 | A5 | 4/1972 | |
| FR | 2554156 | A1 | 5/1985 | |
| FR | 2676488 | A1 * | 11/1992 | E04H 17/161 |
| FR | 2698417 | A1 | 5/1994 | |
| FR | 2722820 | A1 | 1/1996 | |
| FR | 2872191 | A3 | 12/2005 | |
| FR | 2890407 | A3 * | 3/2007 | E04H 17/161 |
| FR | 2978782 | A1 * | 2/2013 | E04H 17/20 |
| FR | 3018088 | A1 * | 9/2015 | E04H 17/161 |
| GB | 128715 | A | 6/1919 | |
| GB | 699117 | A | 10/1953 | |
| GB | 1544915 | A | 4/1979 | |
| GB | 2102465 | A | 2/1983 | |
| GB | 2130618 | A | 6/1984 | |
| GB | 2139666 | A | 11/1984 | |
| GB | 2248643 | A | 4/1992 | |
| GB | 2254360 | A | 10/1992 | |
| GB | 2259924 | A | 3/1993 | |
| GB | 2387609 | B | 9/2005 | |
| GB | 2464760 | A | 5/2010 | |
| GB | 2523181 | A | 8/2015 | |
| GB | 2536312 | A | 9/2016 | |
| GB | 2536312 | A * | 9/2016 | E04H 12/2215 |
| GB | 2539764 | A | 12/2016 | |
| GB | 2559943 | A | 8/2018 | |
| JP | S56-054139 | U | 5/1981 | |
| JP | S57-127757 | U | 8/1982 | |
| JP | H10-227100 | A | 8/1998 | |
| NL | 9201030 | A | 8/1993 | |
| WO | 9703266 | A1 | 1/1997 | |
| WO | 2011009204 | A1 | 1/2011 | |
| WO | 2011135054 | A2 | 11/2011 | |
| WO | 2014040091 | A1 | 3/2014 | |
| WO | 2014062128 | A1 | 4/2014 | |
| WO | 2016141246 | A2 | 9/2016 | |

OTHER PUBLICATIONS

Examination Report dated Aug. 10, 2018 in connection with United Kingdom Application No. GB1802175.8, 4 pages.
Combined Search and Examination Report dated Jan. 8, 2019 in connection with United Kingdom Application No. GB1811865.3, 4 pages.
Search Report dated Feb. 1, 2019 in connection with United Kingdom Application No. GB1816828.6, 1 page.
Error in Search Letter dated Feb. 5, 2019 in connection with United Kingdom Application No. GB1816828.6, 1 page.
Search Report dated May 17, 2019 in connection with United Kingdom Application No. GB 1802175.8, 2 pages.
International Search Report and Written Opinion dated Jun. 24, 2019 in connection with International Application No. PCT/GB2019/050347, 16 pages.
Further Search Report (Claims 11-17, 25) dated Jun. 26, 2019 in connection with United Kingdom Application No. GB1816828.6, 1 page.
Further Search Report (Claims 18-25) dated Jun. 26, 2019 in connection United Kingdom Application No. GB1816828.6, 1 page.
Search Report dated Nov. 5, 2019 in connection with United Kingdom Application No. GB1908039.9, 2 pages.
Combined Search and Examination Report dated Dec. 9, 2019 in connection with United Kingdom Application No. GB1910308.4, 6 pages.
Further Search Report (Claim 24) dated Jan. 6, 2020 in connection with United Kingdom Application No. GB 1908039.9, 2 pages.
Examination Report dated Jan. 10, 2020 in connection with United Kingdom Application No. GB1811865.3, 2 page.
Search Report dated Jan. 16, 2020 in connection with United Kingdom Application No. GB1906646.3, 1 page.
Examination Report dated Feb. 12, 2020 in connection with United Kingdom Application No. GB1908039.9, 3 pages.
Search Report dated Oct. 15, 2020 in connection with United Kingdom Application No. GB2011765.1,1 page.
International Search Report and Written Opinion dated Nov. 18, 2020 in connection with International Application No. PCT/GB2020/051337, 16 pages.
United Kingdom Intellectual Property Office, Examination Report dated Nov. 16, 2021 regarding Application No. GB1816828.6, 2 pages.
United Kingdom Intellectual Property Office, Examination Report dated Feb. 28, 2022 regarding Application No. GB1906646.3, 3 pages.

* cited by examiner

FENCING

CROSS REFERENCE TO RELATED APPLICATIONS

This application is a 371 National Stage of International Application No. PCT/GB2019/050347, filed Feb. 8, 2019, which claims priority to United Kingdom Patent Application No. GB1802175.8, filed Feb. 9, 2018, United Kingdom Patent Application No. GB 1811865.3 filed Jul. 20, 2018, and United Kingdom Patent Application No. GB 1816828.6, filed Oct. 16, 2018, the disclosures of which are herein incorporated by reference in their entirety.

BACKGROUND

The present invention relates to improvements in and relating to fencing, and in particular to fence posts. The invention further relates to a panel-post connector plate, a rail support device, a gravel-board retaining device, a fence post, a method of manufacturing a fence post and a fence system, and generally to fence post assemblies.

Fence posts are typically formed from timber, plastic, concrete or metal. However, timber fence posts are vulnerable to decay over time, particularly rotting which is in part caused by moisture and air exposure to the timber. This is particularly the case for timber fence posts embedded into the ground. Plastic fence posts, whilst typically moisture resistant, can become discoloured or embrittled by exposure to sunlight. Concrete fence posts which are made to be strong enough to be used as fence posts are required to be bulky so that they are too heavy to be manoeuvred. Present metal fence post designs are uneconomical to manufacture and/or are too heavy to be manoeuvred.

Fence posts which are not connected to adjacent fence panels, which may include prefabricated fence panels or a plurality of rails with slats attached thereto, can result in movement and/or wind rattle of fence panels. This may particularly be true for header rails of fence panels.

Gravel boards are typically formed from a material resistant to moisture related damage and are attached between fence posts so as to space a body of the fence panel from the ground. This protects the body of the fence panel from moisture related damage. However, gravel boards can be difficult to hold in place relative to the fence posts when being fastened thereto, especially if one person attempts to construct the fence.

If constructing the fence panel in-situ, rails or cross-members are required to be fixed relative to the fence post. If one person attempts to attach the rail to the fence post, it can be difficult to hold the rail in position by hand and fasten the rail to the fence post.

The present invention seeks to provide a solution to these problems.

SUMMARY

According to a first aspect of the present invention there is provided a panel-post connector plate for connecting a fence post to an adjacent fence panel having a header rail and a panel body, the panel-post connector plate comprising: a plate body having a post-receiving aperture for receiving at least part of the fence post therethrough, and a fastener receiving aperture for receiving a fastener to attach the plate body to the panel-body of the adjacent fence panel; and a header-rail engagement member at or adjacent to the plate body, the header-rail engagement member at least in part upstanding from a plane defined by the plate body and receivable in the in-use header rail of the in-use adjacent fence panel.

A post receiving aperture allows for the post to be quickly secured relative to the plate without requiring a separate fastening means to fasten the plate to the post. Post receiving apertures enables the panel to be connected to the post so as to prevent or limit movement of the panel relative to the post, and thereby prevent wind rattle. This is particularly the case where the panel is not otherwise mechanically connected to the post, for example if the panel is simply slotted into a channel of the fence post. A header-rail engagement member enables the plate to be quickly attached to the header, such as via an interference fit, and does not require separate fasteners. Therefore, the fence post is able to be rapidly connected with the panel and the header rail. Having the form of a plate, which is thin and planar, enables the connector plates to be conveniently stacked. A header rail is considered to be a rail or cross-member which is typically at the top of a fence panel, for example on top of the top rail. The header rail may otherwise be known as top rail trim. The header rail typically does not provide structural support to other parts of the fence and is conventionally for aesthetic or security purposes.

Preferably the header-rail engagement member has a stop for preventing or limiting uplift of the in-use header rail relative to the panel-post connector plate. This prevents or limits the header rail from being removed from the top rail.

Advantageously, the header-rail engagement member may have two said stops, each stop at an opposing lateral edge of the header-rail engagement member for preventing uplift of the in-use header rail at each lateral edge. Two stops prevent the header rail from being pivoted about the single stop and therefore limits the header rail from being removed.

Beneficially, the header-rail engagement member may have a uniform lateral cross-section so as to be slidably receivable in the in-use header rail.

In a preferable embodiment, the header-rail engagement member may extend from an edge of the plate body. The upstanding engagement member therefore does not obstruct further connector plates being stacked on top of the initial connector plate.

Optionally, the header-rail engagement member may include a tongue to space an upstanding portion of the header-rail engagement member from the edge of the plate body. The tongue allows for a cap to be positioned over the connector plates and the engagement member to protrude from beneath the cap so as to engage the header rail. Additionally, the spacing of the upstanding portion from the plate body provides tolerance in positioning additional plates stacked thereon.

Preferably, the fence-post receiving aperture may be arranged so as to receive the fence post in a plurality of orientations. This allows for a single type of panel-post connector plate to be used for panels and header rails arranged relative to the fence post in different directions.

Advantageously, the post-receiving aperture may have an H-shaped or a substantially H-shaped cross-section. An H-shaped cross-section substantially matches a preferred cross-section of the post and the same type of connector plate can be used with the post in at least two directions. The H-shaped cross-section for the post is desirable for structural reasons as will be better understood hereinafter.

Beneficially, a plurality of panel-post connector plates may be stackable. Stackable connector plates allow for multiple connector plates to be used together to connect to multiple header rails. This prevents or limits the requirement to have or manufacture various types of connector plates having differing numbers of engagement members facing in differing directions.

Optionally, the plate body may have a plurality of sides with at least one said fastener receiving aperture at or adjacent thereto. This allows for the plate to be fastened to multiple top rails at or adjacent to differing sides of the plate body.

According to a second aspect of the present invention there is provided a fence post comprising metal folded into a generally H-shaped cross-section, the fence post comprising a central rib that extends longitudinally along a length of the fence post and first and second opposing, and substantially planar, surfaces that extend laterally from the central rib, wherein the central rib comprises a double layer of metal, each layer of the double layers abutting or substantially abutting each other, and the fence post further comprises fixing means for attaching fencing material to the fence post in use.

Suitably, the metal sheet is folded such that the central rib and the first surface comprise a double layer of metal. In a preferred embodiment the second surface comprises a first and second, essentially coplanar, flanges extending laterally from opposite sides of the central rib. Whilst the first and second flanges making the second surface of the post could comprise a double thickness of metal, this is not really necessary from a functional point of view. In a preferred embodiment the first and second flanges making up the second surface of the post comprise only a single layer of metal.

The double layer of the central rib is particularly advantageous, because it imparts strength to the fence post and enables the post and fence made using it to withstand greater force in use, especially forces such as wind acting on the side of the fence.

In addition, the double layer of the first surface means that this surface, which essentially functions as a retaining surface, can be narrower. The narrower first surface can be aesthetically pleasing in use, and also reduces the material cost of manufacturing the fence post. Each of the double layers of the first surface preferably abut each other.

Preferably, the metal is folded in such a way that there is substantially no void between the double layers of the central rib or, if relevant, the double layers of the first surface. Suitably, the folding process involves squeezing together the surfaces of the metal to minimise the void between abutting surfaces. In practice, there may be a small void at the internal corners of the first surface and where the central rib is folded to form the first surface. However, the intention is that these voids should be kept to the minimum possible by the manufacturing technique. There are no fixing means holding the abutting surfaces of the fence post together.

Preferably, the first surface and the second surface of the post, each extend essentially perpendicular to the central rib. Preferably, the first surface and the second surface are substantially parallel to each other.

Preferably, the central rib, together with the first and second surfaces effectively define two channels on opposing sides of the central rib, within which channels fencing material may be received during use. In a preferred embodiment, these channels have a substantially U-shaped cross section.

In a preferred embodiment the first surface of the fence post is narrower than the second surface of the fence post. Alternatively, the first surface may be the same width as the second surface, or the first surface may be wider than the second surface.

The dimensions of the fencing panel can be chosen to suit the particular type of fence being constructed. For example, for applications for residential fencing, the dimensions of the fence post are chosen to compliment the average dimensions of a fencing panel. For example, the depth of the central rib, should be slightly greater than the thickness of an average fence panel, to allow the panel to be inserted in the channel created between the opposing first and second surface of the fence post, without allowing too much movement of the panel once inserted into the channel. An average panel has a thickness of around 48-50 mm, so then the spacing between the East and second opposing surfaces, defined by the depth of the central rib is suitably around 50 mm. The minimum separation of the first and second opposing surfaces, as defined by the depth of the central rib, will depend upon the application, but is suitably at least 15 mm, such as at least 20 mm. The maximum separation of the first and second opposing surfaces, as defined by the depth of the central rib, will also depend upon the application, but is suitably no more than 200 mm, such as no more than 150 mm. The separation of the first and second opposing surfaces, as defined by the depth of the central rib, may be 25 mm or 50 mm or 100 mm.

The width of the first and second surfaces should be sufficient to both allow for secure fixing of the fencing material to the fence post and to support the fencing material when in use. For example, the first and second surfaces are suitably at least 10 mm wide.

The length of the fence post will also be dictated by the application, and a range of lengths can be provided for different fence heights. For example, the fence post may extend for a length of up to 4.0 m and is suitably at least 1.0 m in length. The fence post of the present invention may be provided in any standard fence post length, including but not limited to, 1.5 m, 1.8 m, 2.4 m, 2.7 m, 3 m, 3.3 m or 3.6 m.

The fixing means suitably comprise fixing holes extending through the full thickness of the metal sheet. The fixing holes are placed at suitable locations to allow fencing material, such as fence panels or fence rails, to be fixed to the fence post in use. Whilst the fixing holes may form a series spaced along the full length of the fence post, in an alternative embodiment a plurality of discrete groups of fixing holes are spaced along the length of the fence post. The fixing holes may be equidistantly spaced from one another. The fixing holes may be arranged linearly along the length of the fence post. The fixing holes may be arranged in one or more rows, that may be staggered, extending along the length of the fence post.

In a preferred embodiment, the fixing holes are located in the flanges making up the second surface of the fence post. In this embodiment the second surface is acting as a fixing surface. In an alternative embodiment, the fixing holes may be located in the first surface of the fence post. Any fixing holes in the first surface of the fence post may be in addition to or alternative to any fixing holes in flanges making up the second surface of the fence post.

The average metal thickness of a single layer of the finished rolled fence post is suitably from 1 to 5 mm, preferably from 2-4 mm, most preferably, the single layer thickness of metal is on average 1.5 mm, 2 mm or 3.5 mm.

Preferably, the metal is steel. More preferably, the metal is galvanised steel. The metal may be galvanised and powder coated. Suitably, the fence post is made using a cold-rolling process.

Roll Forming is a continuous process for forming sheet, strip or coiled metal stock into long shapes of essentially uniform cross-section. The material is fed through multiple pairs of contoured forming rolls, which progressively shape the metal until the desired cross-section is produced. In use, the fence post of the present invention is fixed in the ground in an upright orientation. The fence post may be fixed in the ground by any suitable means, for example by concrete. The fence panel or fence rail may be inserted into the channel defined by the central rib and the first and second surfaces, on either side of the fence post. Alternatively, the fence panel or fence rail may be attached to the fence post outside the channel defined by the central rib and the first and second opposing surfaces. Either way, the fence panel or fence rail is then fixed to the fence post through the fixing holes in the fence post, using any suitable fixing means.

A fence post can be provided, comprising a combination of features according to any two or more of the embodiment of the invention. The double layer of the central rib is particularly advantageous, because it imparts strength to the fence post and enables the post and fence to withstand greater force in use, especially forces such as wind acting on the side of the fence.

According to a third aspect of the present invention there is provided a method of manufacturing a fence post according to the second aspect of the present invention, comprising the steps of: a) providing a metal sheet; b) making a first bend of 90 degrees in the metal sheet; c) making a second bend of 90 degrees in the metal sheet after the first bend; d) making a third bend of 180 degrees in the metal sheet after the second bend; e) making a fourth bend of 180 degrees in the metal sheet after the third bend; f) making a fifth bend of 90 degrees in the metal sheet after the fourth bend; and g) making a sixth bend of 90 degrees in the metal sheet after the fifth bend; wherein the first and sixth bends and/or the third and fifth bends abut or substantially abut each other.

According to a fourth aspect of the present invention there is provided a fence system comprising: at least one fence post according to the second aspect of the invention; and at least one fence panel connected to the fence post via a panel-post connector plate according to a first aspect of the invention.

According to a fifth aspect of the present invention, there is provided a gravel-board retaining device for retaining a gravel board relative to a fence post, the gravel-board retaining device comprising: a retaining body; and an attachment means for attaching the retaining body to the fence post; the retaining body being pivotable about the attachment means towards the in-use fence post so as to increase an overlap between the retaining body, in-use gravel board and in-use fence post and thereby retain the gravel board relative to the fence post via positive interengagement with the retaining body.

The gravel-hoard retaining device allows for a gravel hoard to be held in place, prior to permanent fixing. By using a pivotable retaining body, the retaining device is convenient to lock into place. Additionally, the retaining body may be pivoted out of overlap between the gravel board and the fence post, which means that the attachment may be easily detached, if the gravel board is required to be repositioned prior to fastening. Retainment via positive interengagement provides a secure hold without requiring the use of fasteners which can be time consuming to use. The gravel board is here considered to be a rail or cross-member at the bottom or towards the bottom of the fence panel. The gravel board may be formed of a different material to the rest of the fence panel, for example a material which is more resistant to water related damage.

Preferably, the gravel-board retaining device may further comprise an urging means at or adjacent to the retaining body for urging the retaining body against the in-use fence post or the in-use gravel board. The urging means increases a retaining force between the retaining device and the fence post and/or the gravel board as compared to the retaining body alone.

Advantageously, the urging means may further comprise a resilient sloped member having a slope relative to the retaining body. A slope allows for the urging means to be easily inserted. Resilience allows for the sloped member to provide an urging force against the gravel board and/or fence post once the sloped member has been compressed or elastically deformed so as to fit between the gravel board and the fence post.

Beneficially, the resilient sloped member may face an edge of the retaining body which extends away from the attachment means. This allows for the sloped member to in use face towards the fence post so as to be easily inserted between the fence post and the gravel board.

Optionally, the urging means may comprise two said resilient sloped members. Two resilient sloped members allows for a space between them through which a fastener can be inserted. Additionally, it can increase a uniformity of urging force across the retaining body.

In a preferable embodiment, the retaining body may have an aperture therethrough for receiving a fastener which in use fastens the fence post to the gravel board. This enables the retaining device to be used with, at or adjacent to the fastening holes provided in the fence post given that a fastener can still engage the gravel board through the retaining body.

Additionally, the retaining device may further comprise a handle for manually pivoting the gravel-board retaining device. A handle, extending at an angle to the plane of the retaining body, allows for the retaining device to be more easily manually engaged, given that it may otherwise be flush with the gravel board. The handle can also act as a stop to prevent over insertion of the retaining device between the gravel board and the fence post. The handle can allow for at least part of the retaining device to be removed from between the gravel board and the fence post.

According to a sixth aspect of the present invention there is provided a method of retaining an end of a gravel board at or adjacent to a channel of a fence post at a proposed height using a gravel-board retaining device, the method comprising the steps of: a) providing a gravel-board retaining device according to a fifth aspect of the present invention; b) attaching the attachment means of the retaining device at or adjacent to the channel of the fence post at the proposed height; c) inserting the end of the gravel board into the channel at the proposed height at or adjacent to the retaining device; and d) pivoting the retaining body towards the fence post so as to increase an overlap between the retaining body, gravel board and fence post and thereby retain the gravel hoard relative to the fence post via positive interengagement with the retaining body.

According to a seventh aspect of the present invention there is provided a fence system comprising: at least one fence post according to a second aspect of the present invention; and at least one fence panel connected to the fence post via a panel-post connector plate according to a first aspect of the invention; the or each fence panel having a gravel board retained relative to the fence post by a gravel board retaining element according to a fifth aspect of the invention.

Preferably the gravel board is a reinforceable gravel board comprising at least one reinforcement-receiving chamber for receiving a reinforcement therein.

According to an eighth aspect of the present invention there is provided a rail support device for supporting a rail of a fence relative to a fence post, the rail support device comprising: a rail support body at least in part receivable within a channel of a fence post; a projecting member which projects from the rail support body and is fixed relative thereto, the projecting member receivable within a hole of a fence post so as to in use vertically support the rail support device; a receiver at or adjacent to the body and spaced apart from the projecting member for laterally engaging a flange of a fence post; and a support member for supporting the rail.

A rail support device allows for the rail to be temporarily supported. This particularly provides assistance if construction of the fence is being carried out by one person. This is because one end of the rail can be temporarily supported by the rail support device whilst the other end is being positioned. Once the rail is correctly positioned it can be securely fastened into place and so the risk of securing an incorrectly positioned rail is limited. The projecting member being fixed relative to the support body allows for quick vertical securing of the rail support device as it is not required to be manually fastened, as would be the case for a screw. The receiver prevents or limits lateral movement of the rail support device. Given that the receiver and the projecting member are spaced, the projecting member may be more convenient to connect to the fence post because the rail support device can be pivoted about the projecting member to provide space to connect the receiver.

Preferably, the support member includes a gripping means for gripping the rail. A gripping means can prevent to rail from sliding longitudinally between adjacent fence panels. Additionally, the gripping means can prevent the rail from moving laterally relative to the rail support device.

Advantageously, the gripping means may comprise a serrated edge. A serrated edge or serrations can engage or protrude into rails formed from soft material, such a timber. This can provide a strong grip.

Beneficially, the support member may be spaced apart from the projecting member and receiver. Optionally, the support member may be at an edge of the rail support body. Spacing the support member from the engagement members can allow for the rail to be supported, fastened into place and then have the support device easily removed. Therefore, the support device can be more easily used as temporary or reusable support device.

In a preferable embodiment, there are two projecting members which project from opposing edges of the rail support body. Assuming that only one surface of each post has fastener holes, opposing projecting members allows for the same type of rail support device to be used with each lateral side of the fence post.

Preferably, there are two receivers at or adjacent to opposing edges of the rail support body. Two receivers allow for the same type of rail support device to be used with opposing surfaces of the fence post and still receiver a flange of the fence post.

In some examples, the holder clip or support device may be capable of supporting a beam, or portion of a beam, having a mass of at least about 0.5 kg, or at least about 1 kg; and/or at most about 50 kg, or at most about 20 kg, or at most about 10 kg, or at most about 5 kg, when the holder clip is fastened to the fence post. In some examples, the bearing surface or support surface may extend a lateral breadth (when fastened to the fence post as in use) of at least about 1 cm, or at least about 2 cm; at/or at most about 20 cm, or at most about 10 cm, or at most about 5 cm; and/or some example bearing surfaces may have a thickness (or width) of at least about 0.1 cm, and/or at most about 2 cm, or at most about 1 cm, or at most about 0.5 cm.

In some example arrangements, a slot of the holder clip may be substantially perpendicular to the projection, operable to swing the slot over the fin member when the projection is inserted into the fixing hole of the fence post.

According to a ninth aspect of the present invention there is provided a panel-post connector plate for connecting a fence post to an adjacent fence panel, the panel-post connector plate comprising: a plate body having a post-receiving aperture for receiving the fence post therethrough, and an attachment means for attaching the connector plate to the fence panel.

According to a tenth aspect of the present invention them is provided a method of connecting a fence post with a channel to a fence panel with a connector so that the connector is concealable, the method comprising the steps: a) providing a panel-post connector plate according to a ninth aspect of the invention; b) inserting a fence panel into the channel; c) inserting the fence post through the post receiving aperture of the connector plate; d) attaching the connector plate to the fence panel via the attachment means; and e) concealing the connector plate by covering at least part of the connector plate with a cap.

According to an eleventh aspect of the invention, there is provided a fence post assembly comprising a fence post and a holder clip for connecting a cross-beam to the fence post; the fence post comprising a fin member (for example, a flange) including a plurality of holes, which may be through-holes or blind holes; the holder clip comprising a projection extending from a holder body, a slot for receiving the fin member, and a bearing surface; the projection, slot, the fin member and the holes cooperatively configured such that the projection can be inserted into one of the through-holes (operable to prevent at least substantial axial, or vertical, displacement of the holder clip relative to the fence post); and the fin member can be inserted into the slot (operable to limit transverse displacement of the holder body relative to the fence post); the fence post assembly configured such that the holder clip can be fastened to the fence post by inserting the projection into a through-hole and locating the slot over the fin member, and a cross-beam can be placed onto the hearing surface and supported by the holder clip.

Viewed from a twelve aspect of the invention, them is provided a fence post assembly comprising a fence post and a clamp mechanism for fastening the fence post to end portions of a pair of beams (for example, gravel boards), and comprising a clamp plate, an elongate tension member and an attachment mechanism; the fence post and the clamp mechanism cooperatively configured such that the tension member can be fastened to the fence post by means of the attachment mechanism, the tension member connecting the clamp plate to the fence post while under tension, the clamp plate abutting respective end portions of each beam, respective ends of each beam spaced apart from each other by a gap, and the tension member extending through the gap, between the ends; operable to clamp the end portions of the spacer beams against the fence post, the clamp plate covering the gap.

Viewed from a thirteenth aspect, there is provided a fence post assembly comprising a reinforcement member, and a fence post including an end portion; the fence post being mountable into a base by enveloping the end portion with a settable material in a mouldable state and then allowing the settable material to set; the end portion comprising a flange that includes one or more through-holes; the reinforcement member and the through-holes configured and arranged such that the reinforcement member can be inserted through the one or more through-holes, operable to reinforce the sellable material when it has set.

Viewed from a fourteenth aspect, there is provided a fence post assembly comprising a fence post including an end portion, and a stabilisation member; the fence post being mountable into a base by enveloping the end portion with a settable material in a mouldable state and then allowing the settable material to set; the stabilisation plate and the fence post configured such that the stabilisation member can be attached to the end portion of the fence post, operable to stabilise the fence post against displacement in the settable material (and/or in soft ground) before it has set.

Viewed from a fifteenth aspect, there is provided a fence post assembly comprising a plurality of fence posts, each fence post comprising a pair of flanges, each extending laterally from a respective opposite side of a longitudinal central portion having a boss side and an opposite trough side; the fence posts configured such that they can be stacked against one another, the boss side of one fence post inserted into the trough side of an adjacent fence post.

A fence post assembly can be provided, comprising a combination of features according to any two or more of the aspects of this disclosure.

A fence post assembly can be provided, comprising a fence post assembly according to any one or more of the aspects of this disclosure, and a fence panel; and/or a plurality of spacer beams (for example, gravel boards); and/or one or more cross-beams.

Various example arrangements, features and combinations of features of fence assemblies and holder clips are envisaged by this disclosure, of which the following are non-limiting, non-exhaustive examples.

In some example arrangements, the bearing surface of the holder clip may include a purchase means for resisting sliding movement of a cross-beam supported by the holder member. For example, the bearing surface may include a plurality of serrations; and/or the hearing surface may be a side of the holder body.

In some examples, the holder clip may be capable of supporting a beam, or portion of a beam, having a mass of at least about 0.5 kg, or at least about 1 kg; and/or at most about 50 kg, or at most about 20 kg, or at most about 10 kg, or at most about 5 kg, when the holder clip is fastened to the fence post. In some examples, the bearing surface may extend a lateral breadth (when fastened to the fence post as in use) of at least about 1 cm, or at least about 2 cm; at/or at most about 20 cm, or at most about 10 cm, or at most about 5 cm; and/or some example bearing surfaces may have a thickness (or width) of at least about 0.1 cm, and/or at most about 2 cm, or at most about 1 cm, or at most about 0.5 cm.

In some example arrangements, the slot of the holder clip may be substantially perpendicular to the projection, operable to swing the slot over the fin member when the projection is inserted into the through-hole. In other words, a user may insert the projection into a through-hole, and place the slot over the fin (insert the fin member into the slot). In some examples, the holder clip may comprise pair of projections, each projecting from an opposite side of the holder body; and the holder clip may comprise a pair of slots on opposite sides of the holder body, allowing either side of the holder clip to be attached to the fin of the fence post. In some example arrangements, the slot and the projection may be configured such that when the holder clip is fastened to the fence post as in use, the slot may prevent, or resist, the projection from being laterally withdrawn from the hole in the fin member; the holder clip may be detached from the fence post by sliding the slot away from the fin, and then withdrawing the projection from the hole.

In some example arrangements, the fence post may comprise a pair of substantially coplanar fins or fin members in the form of flanges, each extending laterally from a respective opposite side of a longitudinal central portion. The central portion may comprise a longitudinally-extending channel structure, having a boss side and an opposite trough side; for example, each fence post may include an elongate portion being generally U- or V-shaped in transverse cross-section. The central portion may comprise an opposite pair of side walls, each side wall connecting a respective flange with a base wall that is laterally spaced apart from the flanges; the flanges may be substantially coplanar and the base wall may lie on a plane substantially parallel to the flanges. The side walls may be tapered inwards from the flanges, such that the width of the base wall (from one side wall to the other) is substantially less than the width of the mouth of the channel structure (from one flange to the other); in a configuration may allow a plurality of fence posts to be stacked against one another, the boss side of one fence post fitting into the trough side of an adjacent fence post.

In some example arrangements, the plurality of through-holes in the fin (or in both fins) may be arranged in a line, spaced substantially equidistant from each other. The through-holes may extend from proximate one end of the fence post to proximate an opposite end.

In some examples, each fin (or flange) may include holes arranged in at least two lines, in which the holes of the two lines may be positioned in a staggered arrangement. In some example arrangements, one line of holes may be for receiving a fastening mechanism for fastening cross-beams to the fence post, and the other line of holes may be for receiving the projecting member of the holder clip, which may be used to support a cross-beam while it is being fastened to the fence post.

In some example arrangements, the fence post may comprise a pair of fin members (or flanges), each fin member extending laterally from a respective opposite side of a longitudinal central portion having a boss side and an opposite trough side; a through-hole connecting the boss side and trough side; the central portion, the through-hole, the tension member and the attachment mechanism configured such that a distal end portion of the tension member can be inserted into the through-hole; a proximal end portion of the tension member attached to the clamp plate; the respective end portion of each beam positioned between the clamp plate and a respective fin member; operable to clamp the respective end portion of each beam against the respective fin in response to fastening the attachment mechanism to the end portion of the tension member. For example, the attachment mechanism may comprise a threaded nut corresponding threading on the end portion of the tension member; the tension member may comprise a bolt having a head and threaded end portion.

In some example arrangements, the attachment mechanism may comprise a clamp block that is configured to fit into the trough side of the central portion and includes a hole for receiving and fastening an end portion of the tension member; the clamp mechanism and fence post arranged such that when assembled as in use, the boss side of the central portion faces towards the clamp member, the beams are clamped against the respective fin members, the clamp block is positioned in the trough side of the central portion, and the end portion of the tension member is fastened to the clamp block.

In some example arrangements, the reinforcement bar may comprise a U-shaped steel bar for reinforcing concrete, the flange includes at least two through-holes, each for receiving a respective arm of the reinforcement bar. Some example fence post assemblies may include at least two reinforcement bars, the fence post comprising a pair of flanges, each extending laterally from a respective opposite side of the central portion, each flange including at least one through-hole for receiving one of the reinforcement bars.

In some example arrangements, the stabilisation plate can be fastened to an end of the fence post.

In some examples of fence post assemblies comprising a reinforcement member and/or a stabilisation member that can be attached to the end portion of the fence post, the end portion may be mountable in a base comprising or consisting essentially of concrete or cement. In some examples, the settable material may comprise or consist of precursor material for concrete or cement, which may be in the form of a slurry including water. As used herein, 'settable material' can be provided in a form that can be moulded, or poured, around the end portion of the fence post, and the settable material can set; some sellable materials may behave as substantially plastic or liquid material. As used herein, 'setting' of settable material may include drying, and/or curing, and/or hardening, and/or solidification. For example, a hole may be provided in the ground, the end portion inserted into the hole and the settable material poured into the hole.

The stabilisation member may comprise a plate body, having a plate-like portion, comprising an attachment means for attaching the stabilisation plate to the end of the end portion of the fence post, the plate-like portion arranged substantially perpendicular to the longitudinal axis of the fence post.

In some example arrangements, the central portion of the fence post may comprise a pair of side walls, each connecting a respective flange to a respective opposite side of a base wall, the side walls defining an included angle of 10° to 30°; this may allow the boss side of one fence post to be inserted into, and in contact with, the trough side of an adjacent fence post in a stack of fence posts.

In some examples, the fence post, and/or the clamp plate and the tension member, may comprise or consist essentially of a steel alloy, such as a grade of stainless steel.

In some example arrangements, the fence post assembly may include an elongate cover panel, configured such that the cover panel can fit over the fence post to substantially conceal a side of the fence post. For example, the cover panel may be configured to fit over, and/or to receive, the boss side of the central portion of the fence post; and may fit against respective sides of each flange. The cover panel may comprise or consist essentially of wood material.

BRIEF DESCRIPTION OF THE DRAWINGS

The invention will now be more particularly described, by way of example only, with reference to the accompanying drawings, in which.

DETAILED DESCRIPTION

Figure 1:
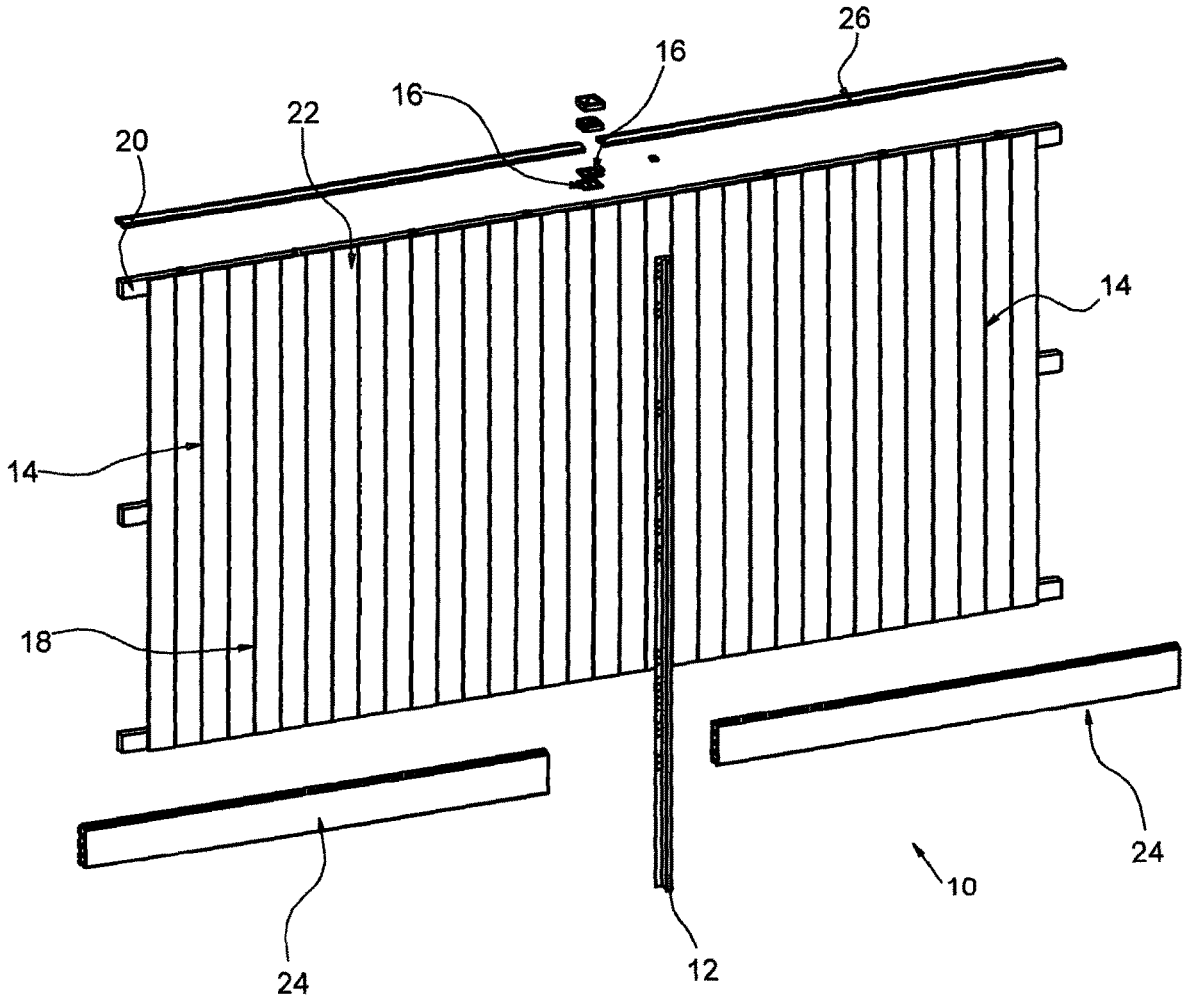
FIG. 1 shows an exploded view of a fence system according to a fourth aspect of the invention including two panel post connector plates according to a first embodiment in accordance with the first aspect of the present invention, an embodiment of a fence post in accordance with a second aspect of the present invention.
Figure 2:
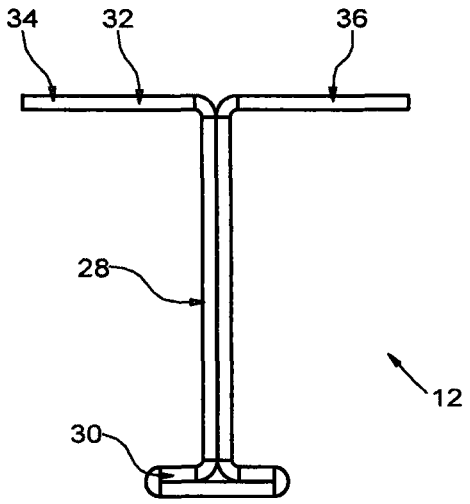
FIG. 2 shows a cross section of the fence post of FIG. 1.

Referring firstly to FIG. 1 there is shown a fence section 10 of a fence. The fence section 10 comprises a fence post 12 and a fence panel 14 attached thereto via a panel-post connector plate 16. The fence panel 14 here comprises a panel body 18 which may include a plurality of rails 20 and slats 22, boards or pickets. The fence panel 14 further comprises a gravel board 24 and a header rail 26. The fence panels 14 are preferably formed at least in part from timber, although it will be appreciated that other materials such as plastics or metal may be considered.

With reference to FIGS. 2 to 5, an example fence post 12 is made from a single length of metal that has been folded into a generally H-Shaped cross section. The post 12 comprises a central rib 28, which extends between opposing first and second surfaces, generally designated by reference numerals 30 and 32 respectively. Whilst described as H-shaped or substantially H-shaped, it will be appreciated that fence post 12 may be considered to be I-shaped, substantially I-shaped, T-shaped or substantially T-shaped. The fence post 12 has two U-shaped or substantially U-shaped channels defined by the first and second surfaces 30, 32 and the rib 28. Whilst the post is shown as being planarly facetted, it will be appreciated that it may in fact have curvate surfaces.

It can be seen that the central rib 28 and the first surface 30, comprise a double thickness of metal, whereas two flanges 34 and 36, forming the second surface 32 comprise only a single thickness of metal. Therefore, each of the central rib 28 and the first surface 30 comprise two layers of material, each said layer abutting or substantially abutting each other. Such abutment provides a strong arrangement resistant to bending or torsion forces and/or prevents or limits gaps within the metal post.

In the embodiment illustrated in the figures hereof, the first surface 30 is narrower than the opposing second surface 32. The second surface 32 comprises the two flanges 34 and 36. However, it will be appreciated that the first surface may be the same width as the second surface or the second surface may be narrower than the first surface.

Figure 3:
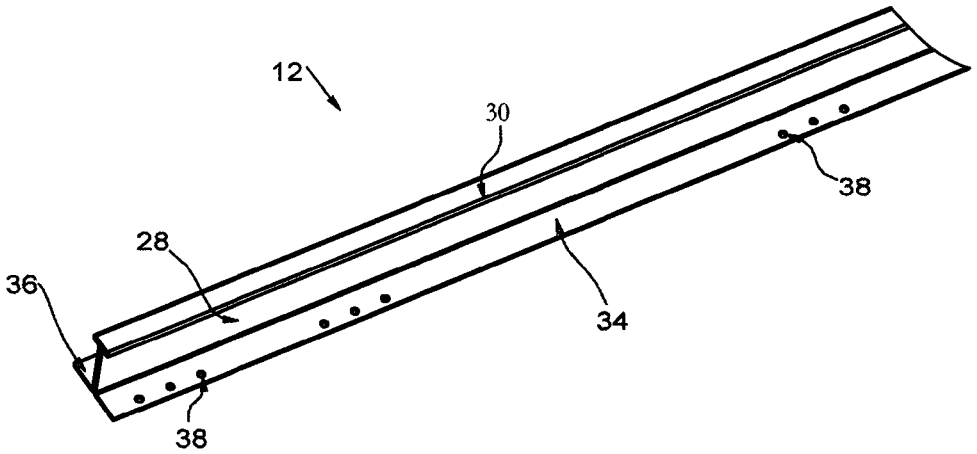
FIG. 3 shows a perspective view of a portion of the fence post of FIG. 1.
Figure 4:
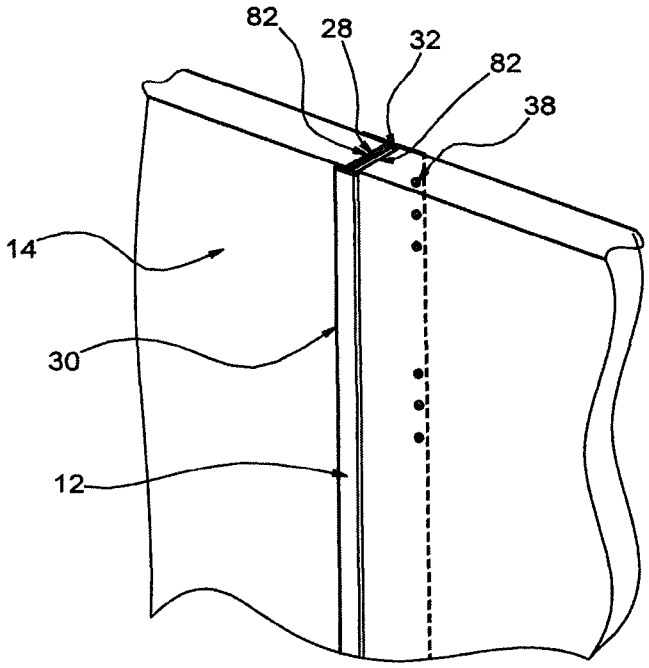
FIG. 4 shows a perspective view of a portions of the fence post of FIG. 1 with in use panels of a fence indicated.
Figure 5:
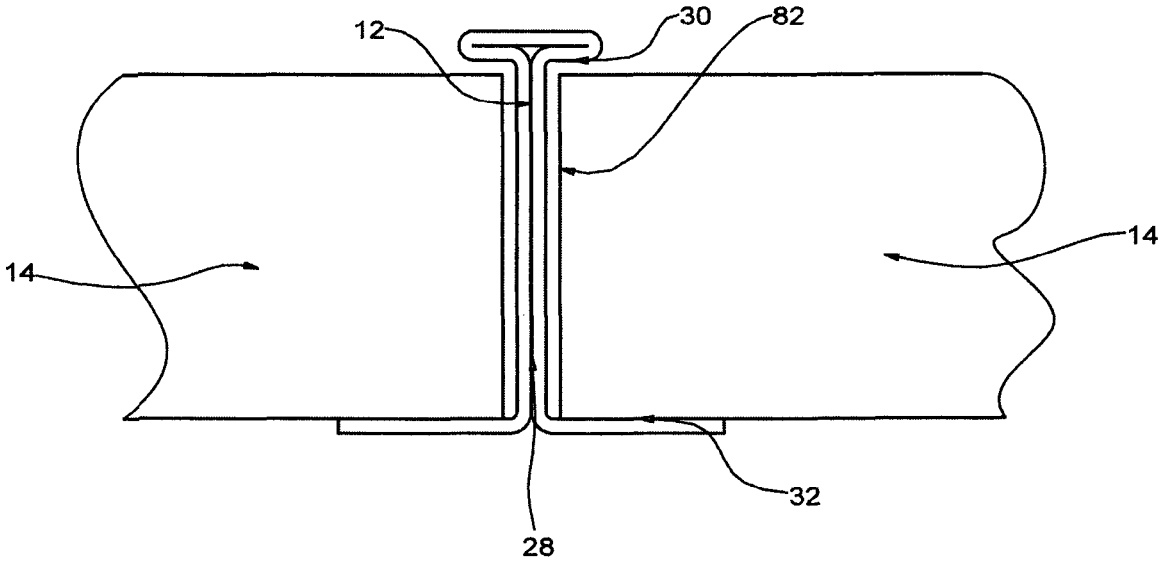
FIG. 5 shows a cross section of the fence post of FIG. 1 with in use panels of a fence indicated.

As illustrated in FIGS. 3 and 4, the single thickness flanges 34 and 36 comprise a series of fixing holes 38 therein to allow fencing material, such as panels 14 or rails 20, to be fixed to the post 12.

In the figures, the fixing holes 38 are shown as being in discrete groups that extend along the length of each flange 34, 36. However, it will be appreciated that a series of fixing holes could extend along the full length of each flange 34, 36.

The fence post 12 is formed from cold-rolled metal, and more preferably cold-rolled steel, although other cold rolled metals such as aluminium or titanium may be considered. A cold-rolling process provides a material with a greater strength than a hot rolling process. Cold rolled metal can be harder than hot rolled metal and therefore may not be conventionally used for folded purposes. The metal may be galvanised to prevent corrosion, although stainless steel may additionally or alternatively be used.

The fence post 12 may be formed by first providing a metal sheet. Next a first bend of 90 degrees is made in the metal sheet to define the first flange 34 of the second surface 32 between the first bend and the end of the sheet. A second bend of 90 degrees is next made in the metal sheet after the first bend to define one of the layers of the central rib 28 between the first and second bends. Then a third bend of 180 degrees is made in the metal sheet after the second bend to define an inner part of the first surface 30 between the third and second bends. A fourth bend of 180 degrees in the metal sheet is made after the third bend to define the outer layer of the first surface 30 between the third and fourth bends. A fifth bend of 90 degrees in the metal sheet after the fourth bend to define a further inner part of the first surface 30 between the fourth and fifth bends. A sixth bend of 90 degrees is made in the metal sheet after the fifth bend to define the second layer of the central rib 28 between the fifth and sixth bends and the second flange 36 of the second surface 32 between the sixth bend and the end. The bending is such that the two layers of the central rib 28 abut or substantially about each other. Here this is achieved by having the first and sixth bends and/or the second and fifth bends abutting or substantially abutting each other. However, it will be appreciated that the layers may about each other by having the central rib layers bending curvately towards each other. It will be appreciated that the bends may take place in any order and/or may be carried out simultaneously. Whilst the bends are described as being 90 degrees or 180 degrees, it will be appreciated that the bends may be substantially 90 degrees and substantially 180 degrees, or between 80 degrees and 100 degrees and between 170 degrees and 190 degrees.

In use, to construct the fence, a lower part of each fence post 12 is inserted into the ground and may be secured in place, for example via concrete although other securing means may be considered.

Figure 6:
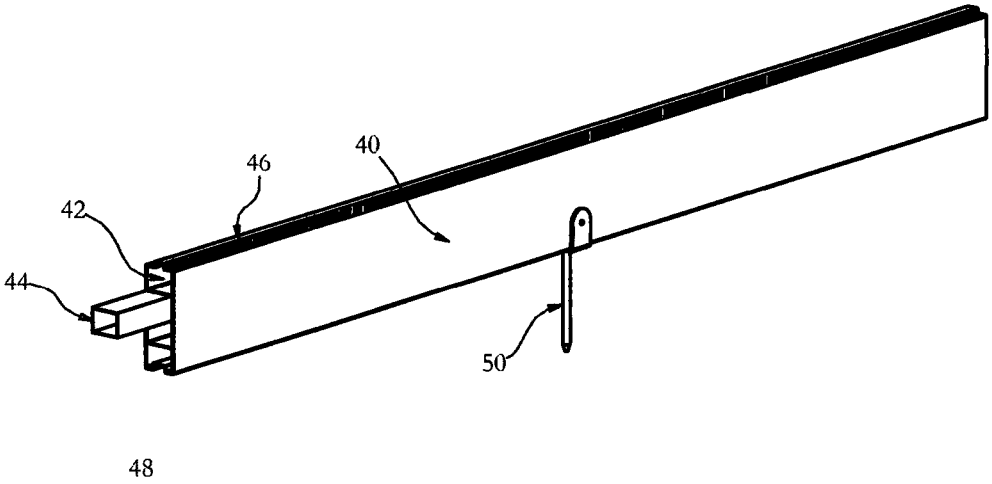
FIG. 6 shows a reinforced gravel board.

A gravel board 24, for example as shown in FIG. 6, may be desired to be retained or attached between two adjacent fence posts 12 so as to form a bottom of the fence panel 14. The gravel board 24 is preferably a reinforceable gravel board and therefore comprises a gravel-board body 40 having a plurality of reinforcement-receiving chambers 42. The reinforcement-receiving chambers 42 extend through at least part of a longitudinal extent of the gravel-board body 40, and preferably through the entire longitudinal extent of the gravel board 24. Hem there am four reinforcement-receiving chambers 42, although it will be appreciated that any number of reinforcement-receiving chambers may be included, including only a single chamber.

The reinforceable gravel board 24 includes at least one reinforcement 44, which is insertable into and/or receivable by the or each reinforcement-receiving chamber 42. The or each reinforcement 44 is preferably hollow and may be tubular. The gravel board 24 and/or reinforcement 44 may be formed by an extrusion process and may be formed from aluminium, although treated timber may also be considered.

A plurality of gravel boards 24 is preferably stackable and/or interconnectable in use. Therefore, the top and bottom edges comprise top and bottom connectors 46, 48 respectively. A top connector 46 of a first gravel board is mutually interengageable and/or connectable with a bottom connector 48 of a second gravel board. Here the top connector 46 includes a ridge and the bottom connector 48 includes a channel, the ridge being receivable in the channel. However, it will be appreciated that the top and bottom connectors may comprise any combination of male or female connectors or engagement elements.

The gravel board 24 further comprises a ground peg 50 having a board receiver for receiving and/or supporting at least part of the gravel board and a ground insertion portion for insertion into the ground.

Figure 7:
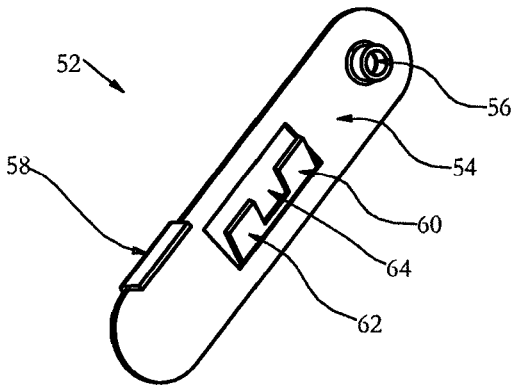
FIG. 7 shows an embodiment of a gravel-board retaining device in accordance with a fifth aspect of the invention.
Figure 8:
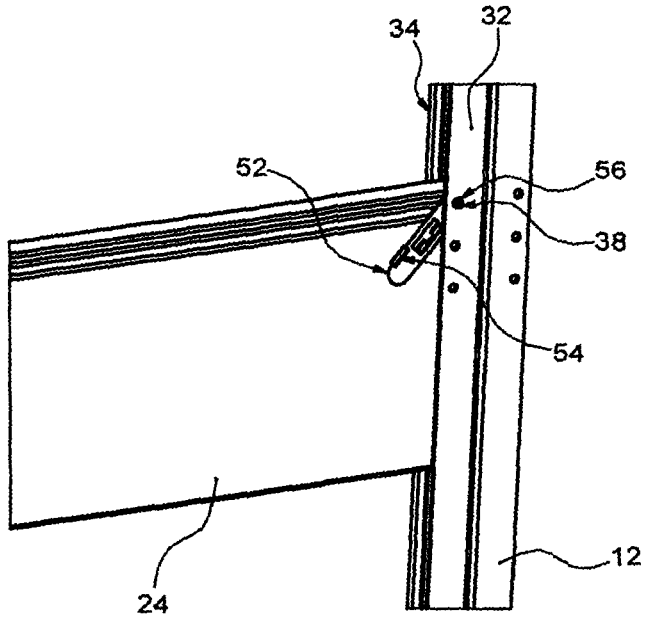
FIG. 8 shows the gravel-board retaining device of FIG. 7 in use.

Referring to FIGS. 7 and 8 the gravel board 24 may be held in place relative to and/or attached to the fence post 12 via a gravel-board retaining device 52. In use the gravel board 24 is preferably received between the first and second surfaces 30, 32 at a proposed height above the bottom of the fence post so that an end of the gravel board 24 engages a rib. The gravel-board retaining device 52 comprises a retaining body 54 and an attachment means 56 for attaching the retaining body 54 to the fence post 12.

The retaining body 54 is preferably thin, substantially planar and elongate such that it may be considered to be a plate or strip. The attachment means 56 is preferably positioned at or adjacent to an end of the retaining body 54. The retaining body 54 has curved ends and here has a stadium shape, although it will be appreciated that the retaining body may not be curvate and any other shape may be considered.

In use, the gravel-board retaining device 52 is pivotably or rotatably attached to the fence post 12 via the attachment means 56 interengaging with a fixing hole 38 in the second surface 32. Here the attachment means 56 is a protrusion receivable in the fixing hole 38. The gravel-board retaining device 52 may then be pivoted so that a portion of the retaining body 54 does not overlie the second surface 32. The gravel board 24 is inserted between the first and second surfaces 30, 32. The retaining body 54 is then pivotable about the attachment means 56 towards the fence post 12 so as to increase an overlap between the retaining body 54, gravel board 24 and fence post 12. This retains the gravel board 24 relative to the fence post 12 via positive interengagement with the retaining body 54. The overlap is increased by at least part of the portion of the retaining body 54 which did not overlie the second surface 32 and is distal to the attachment means 56, being received between the gravel board 24 and the first surface 30 of the post 12. The retaining body 54 therefore increases a force between the gravel board 24 and the first and second surfaces 30, 32 of the fence post 12 and/or urges the gravel board 24 towards the first surface 30. This releasably retains the gravel board 24 to the fence post 12 via an interference fit.

The gravel-board retaining device 52 further comprises a handle 58 or user-engagement portion for manually pivoting the gravel-board retaining device 52. Here the handle 58 is a strip which upstands from an edge of the retaining body 54 which is in use distal to the fence post 12. Therefore, the handle 58 may also act as a stop to prevent full insertion of the retaining body 54 between the fence post 12 and the gravel board 24.

To increase the retention force between the gravel-board retaining device 52, fence post 12 and gravel board 24, the retaining device 52 preferably further comprises an urging means 60 at or adjacent to the retaining body 54 for urging the retaining body 54 against the in-use fence post 12 or the in-use gravel board 24. The urging means 60 here comprises a resilient sloped member 62 having a slope relative to the retaining body 54 and a slope of the resilient sloped member 62 faces an edge of the retaining body 54 which extends away from the attachment means 56. In use the slope at least in part faces the fence post 12.

The sloped member 62 here in use upstands in a general direction of and/or is angled towards the fence post 12, although it will be appreciated that it may upstand in a direction of the gravel board 24. The sloped member 62 is here an upstanding or sloped flap and may be resiliently flexible and/or elastically deformable about the interconnection between the flap and the retaining body 54. In use, as the retaining body 54 is inserted between the gravel board 24 and the post 12, the sloped member 62 rides along an edge of the post so that it is forced downwards and towards the retaining body 54. Once in position, the resilience of the sloped member 62 biases the retaining body 54 away from the fence post 12 and towards the gravel board 24 so as to increase the force of the retention therebetween.

Here, the urging means 60 comprises two said resilient sloped members 62, although it will be appreciated that there may be only one resilient sloped member 62 or more than two. Additionally, whilst described as comprising sloped members 62, it will be appreciated that the urging means may include non-sloped members instead of sloped members, as long as they upstand from the retaining body and are resilient and/or resiliently flexible. The sloped members may here be considered to be leaf springs and the urging means may alternatively include other biasing means, such as helical springs.

Preferably, the retaining body 54 has an aperture 64 therethrough. Such an aperture 64 is here between the two sloped members 62, although it will be appreciated that it may be through other parts of the retaining body. The aperture 64 is preferably for receiving a fastener, such as a screw, which may be inserted through one of the fixing holes 38 in the fence post 12 and into the gravel board 24. Such fasteners may be used to fix the gravel board 24 relative to the fence post 12, although it will be appreciated that fasteners may not be necessary and that the gravel-board retaining device 52 may solely be used to fix the gravel board 24 to the fence post 12.

Whilst described as for being gravel boards 24, it will be appreciated that the retaining device 52 may in fact retain other rails 20 or cross members, including those spaced apart from the ground. Therefore, the retaining device 52 may be a rail retaining device or a fence member retaining device.

Figure 9:
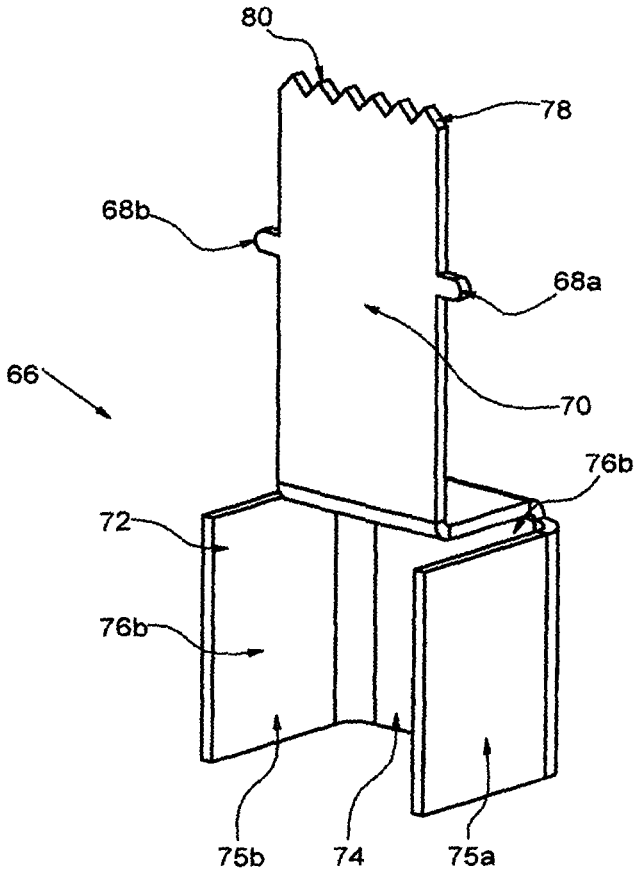
FIG. 9 shows an embodiment of a rail support device in accordance with an eighth aspect of the invention.
Figure 10:
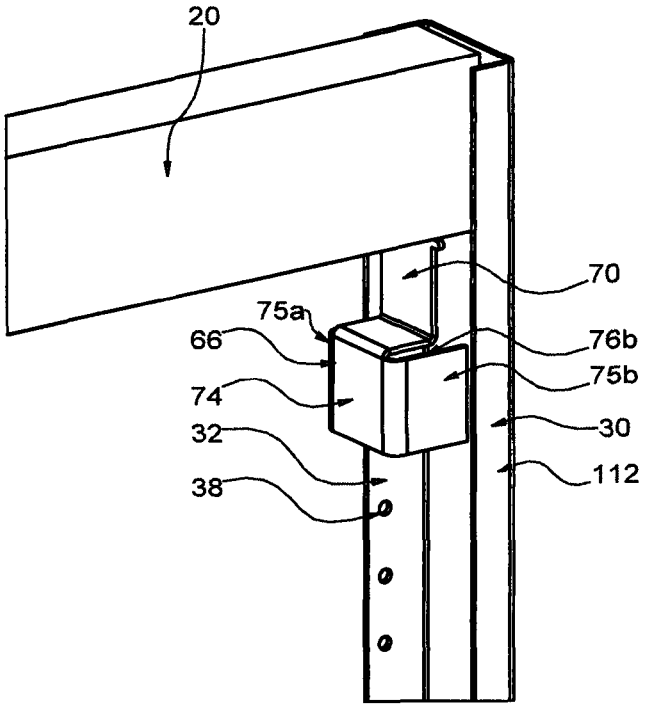
FIG. 10 shows the rail support device of FIG. 9 in-use being supported by a U-shaped bracket and supporting a rail.

Having attached the gravel board 24 between adjacent fence posts 12, rails 20 or cross beams are then attached between adjacent fence posts 12 in the instance that prefabricated panels are not being used. Referring to FIGS. 9 and 10, to temporarily hold an end of a rail 20 relative to the fence post 12, a holder clip 66 or rail support device may be used. FIG. 10 shows the holder clip 66 being supported by a side wall of a U-shaped bracket, rather than a flange of a fence post, although the use of the holder clip is similar or identical with the fence post 12. The function of the U-shaped bracket will be better understood hereinafter.

The holder clip 66 or rail support device comprises a pair of projections, projecting members or lugs 68*a*, 68*b* from opposite sides of a holder body or rail support body 70, and a brace mechanism comprising a raised portion 74 of the holder body or rail support body 70 and a pair of flanges 75*a*, 75*b* extending from opposite sides of the raised portion 74, and bent backwards to form respective slots 76*a*, 76*b* between each flange 75*a*, 75*b* and the raised portion 74. The projections 68*a*, 68*b* are preferably rounded and extends from the holder body 70 which is plate like. The projections 68*a*, 68*b* preferably have a breadth slightly less, or substantially equal to, than the diameter of the holes 38, and a semi-circular end. Each of the slots 76*a*, 76*b* is configured for receiving one of the flanges 34, 36 of the second surface of the fence post 12. The projections or projecting member 68*a*, 68*b* of the holder clip 66 or rail support device, and the holes 38 in the fence post flanges 34, 36 are configured such that each projection can be inserted into a hole 38 to support the holder clip 66 or rail support device against dropping from the fence post 12 under gravity when loaded with the cross-beam 20 or rail. Here each slot 76*a*, 76*b* may be considered to be a receiver so in the described embodiment the brace mechanism may comprise two receivers. The raised portion 74 and each flange 75*a*, 75*b* may be considered to be part of the holder body 70. Therefore, the holder body may at least in part define the slots 76*a*, 76*b* and thus each receiver.

The or each projecting member 68*a*, 68*b* in use vertically supports the rail support device. The projecting member 68*a*, 68*b* is fixed relative to the rail support device and is preferably unitarily formed therewith as a one piece. A top bearing surface or support member 78 of the holder body or rail support body 70 includes a gripping means 80, which is here serrations or a serrated edge. Such gripping means 80 or serrations is for retaining a cross-beam 20 against sliding off the bearing surface or support member 78 when supported against it. The support member 78 is preferably spaced apart from the projecting member and receiver. Here, the support member 78 is at an edge of the rail 20 support body. The holder body 70 is preferably at least in part receivable between the first and second surfaces 30, 32 of the fence post 12 and therefore is for being received between flanges of a fence post 12. The projecting members 68*a*, 68*b* are preferably planar of substantially planar and are preferably coplanar with a least part of the holder body 70 and the support member 78. The support member 78 preferably extends in use above the projecting members 68*a*, 68*b*.

When a fence is being assembled, and a user is fastening opposite ends of a cross-beam 20 to respective neighbouring or adjacent fence posts 12, respective holder clips 66 or rail support devices may be used to support each of the ends until the cross-beam 20 has been fastened to the fence posts 12. An example holder clip 66 or rail support device can be attached to the fence post 12 by inserting a projection 68*a*, 68*b*, extending from a side of the holder body or rail support body 70, into a hole 38 in one of the fence post flanges 34, 36, and placing, lowering or swinging the brace mechanism 72 or one of the receivers over the flange 34, 36; in other words, inserting the flange 34, 36 into the slot 76*a*, 76*b* on the same side of the holder body or rail support body 70. Thus, the brace mechanism 72 or receiver stabilises the holder clip 66 or rail support device against lateral movement; the combined effects of the inserted projection and the brace mechanism 72 or receiver is to fasten the holder clip 66 or rail support device to the fence post 12, so that an end portion of the cross-beam 20 can be supported on the bearing surface or support member 78 of the holder clip 66 or rail support device. When the cross-beam 20 has been fastened directly to the fence post 12, then the holder clip 66 or rail support device can be detached from the fence post 12 and reattached at a different position, for supporting a different cross-beam.

Whilst here there is shown two projecting members which project from opposing edges of the rail support body and/or the receiver comprising two slots at or adjacent to opposing edges of the rail support body, it will be appreciated that this may not be the case. For example, there may be only one projecting member and the receiver may comprise one slot, preferably at or adjacent to the same side of the holder body or rail support body.

Referring again to FIGS. 4 and 5, the relative positioning of a fence panel 14 or rail 20 relative to the post 12 when in use is shown. It can be seen that the edge 82 of the panels 14 or rails 20 align with the central rib 28 of the fence post 12 in use and the surfaces 28 and 30 of the panels or rails 20 align with the second surface 32 and the first surface 30 of the fence post 12 in use. The panels 14 or rails 20 are fixed to the post 12 using fixings that extend through the fixing holes 38 in the post 12 into the panel 14. Here, the first surface 30 functions as a retaining surface and the second surface 32 functions as a fixing surface.

The post comprises fixing holes 38 only in the second surface 32 of the post 12. However, it will be appreciated that the post could comprise fixing holes 38 in the first surface 30 of the post, either in addition or instead of the fixing holes 38 in the second surface 32.

The double layer arrangement of the central rib 28 provides strength to withstand greater forces in the front-back direction, compared to a similar fence post with only a single layer for the central rib.

Slats 22 may then be attached across the rails 20 to form the panel body 18 of the fence panel 14.

Figure 11:
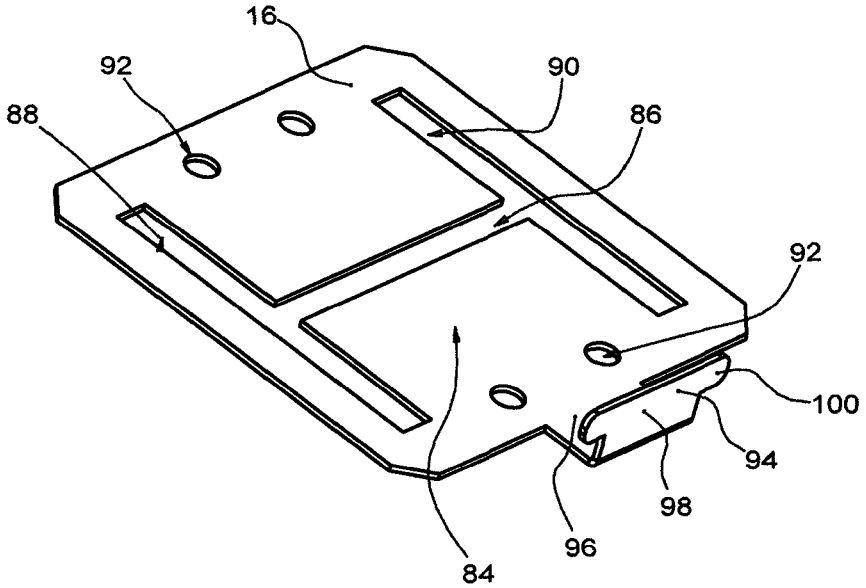
FIG. 11 shows the panel-post connector plate of FIG. 1.
Figure 12:
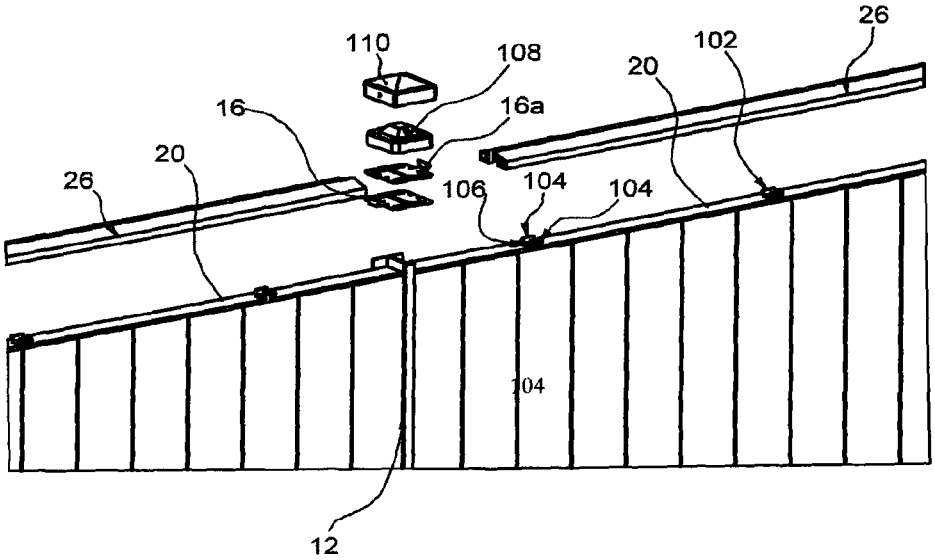
FIG. 12 shows an enlarged view of FIG. 1.

The panel body 18 and/or header rail 26 is then required to be attached to be connected to the fence post 12. Referring to FIGS. 11 and 12, the panel-post connector plate 16 may be used. Here the panel-post connector plate 16 comprises a plate body 84 having a post-receiving aperture 86 for receiving at least part of the fence post 12 therethrough. The post-receiving aperture 86 is preferably arranged so that walls of the aperture engage and/or tightly engage the fence post 12, although the fence post may be spaced apart from the edge of the aperture. The post-receiving aperture 86 may additionally be arranged so as to receive the fence post 12 in a plurality of orientations, therefore the post-receiving aperture 86 may have at least one line of symmetry. Here the post-receiving aperture 86 has an H-shaped or a substantially H-shaped cross-section and thus is similar to the shape of the fence post 12. However, the front and back portions 88, 90 of the post-receiving aperture 86 have similar or identical widths, whereas the first and second surfaces 30, 32 of the fence post 12 have differing widths to each other.

Therefore, the top and bottom portions may receive either the first or second surface 30, 32 of the fence post 12.

The panel-post connector plate 16 further comprises a fastener receiving aperture 92 for receiving a fastener to attach the plate body 84 to the panel body 18 of the adjacent fence panel 14. The plate body 84 has at least one said fastener receiving aperture 92 at or adjacent to opposing sides of the plate body 84, this enables the plate body 84 to be fastened to each panel body 18 adjacent to the fence panel 14. Here there are three fastener receiving apertures 92 on each opposing side of the plate body 84. Whilst fastener receiving apertures 92 are described, it will be appreciated that any alternative attachment means may be considered. For example, the attachment means may include at least one pre-formed spikes or gripping element for embedding into the top of the panel.

The panel-post connector plate 16 preferably includes a header-rail engagement member 94 at or adjacent to the plate body 84. The header-rail engagement member 94 may alternatively be described as a male engagement member or key. The header-rail engagement member 94 at least in part upstands from a plane defined by the plate body 84 and is receivable in the header rail 26 of the adjacent fence panel 14. The header-rail engagement member 94 extends from an edge of the plate body 84. Here the header-rail engagement member 94 includes a tongue 96 to space an upstanding portion 98 of the header-rail engagement member 94 from the edge of the plate body 84. The tongue 96 is preferably coplanar with the plate body 84. The header-rail engagement member 94 is preferably unitarily formed with the plate body 84.

The header-rail engagement member 94 has a stop 100 for preventing or limiting uplift of the in-use header rail 26 relative to the panel-post connector plate 16. Here the stop 100 is a projection which extends outwards from a body of the engagement member 94, the stop 100 extending in a lateral direction as compared to tongue 96. The stop 100 is unitarily formed and coplanar with a body of the header-rail engagement member 94. Here the stop 100 is at or adjacent to the top of the header-rail engagement member 94 The header-rail engagement member 94 has two said stops 100, each stop 100 at an opposing lateral edge of the header-rail engagement member 94 for preventing uplift of the in-use header rail 26 at each lateral edge. The header-rail engagement member 94 has a uniform lateral cross-section so as to be slidably receivable in the header mil 26.

The header rail 26 is elongate having a channel, keyway, recess or grove which extends at least part of the way therethrough for receiving the header-rail engagement member 94. The channel may be considered to be a female engagement member 94 and has a lip at each lateral edge for engagement with the stops 100 of the header-rail engagement member 94.

In use, in the instance that two linearly aligned fence panels 14 are at the fence post 12, as shown in FIG. 12, the panel-post connector plate 16 is positioned over the fence post 12 so that a top portion of the fence post 12 is received through the post-receiving aperture 86. The plate body 84 engages the adjacent top rail 20 of each of the fence panels 14 and the fastener receiving apertures 92 overlap each header rail 26. The connector plate is orientated so that the header rail 26 engagement member 94 is aligned with and/or overlies one of the top rails 20 with the upstanding portion 98 upstanding from the rail 20.

A further panel-post connector plate **16*a* is then also positioned over the fence post 12, and is preferably identical to the initial connector plate 16. The further connector plate 16*a* is conveniently stacked on the initial connector plate 16, given that the plate bodies are planar. The fastener receiving apertures 92 of the connector plates 16, 16*a* are aligned with each other and the header rail 26 engagement member 94 is aligned with and overlies the other of the top rails 20. Fasteners, such as nails, may then be secured through the fastener receiving apertures 92. One header rail 26 can then be slid along each top rail 20 so that the header-rail engagement member 94 at the associated top rail 20 is received within the channel of the associated header rail 26. In this way the header rail 26 is secured relative to the post 12 and uplift of the header rail 26** is prevented or limited.

The top rail 20 of the fence preferably has at least one header-rail engagement element 102, and these may have two stops 104 and a fastener receiving surface 106 or aperture for receiving a fastener so as to attach the header-rail engagement element 102 to the top rail 20. The header rail 26 is slid over the header-rail engagement elements 102 to additionally secure it thereto.

Before or after securing the header rails 20, an adaptor 108 is secured over the top of the fence posts 12 and the connector plates 16, **16*a*. The adaptor 108 can hold the connector plates 16, 16*a* in place and is preferably formed from plastics, although other materials may be considered. After this a cap 110 is secured over the top of the adaptor 108, the cap 110 preferably being metal with hot dip galvanisation to offer maximum corrosion resistance. The cap 110** can be powder coated to colour match the post.

In the instance that only one fence panel 14 is adjacent to the fence post 12, for example at the end of the fence, only one connector plate 16 is required to be used over the fence post 12. Any overhang of the connector plate 16 from the fence post 12 may be trimmed.

Figure 13:
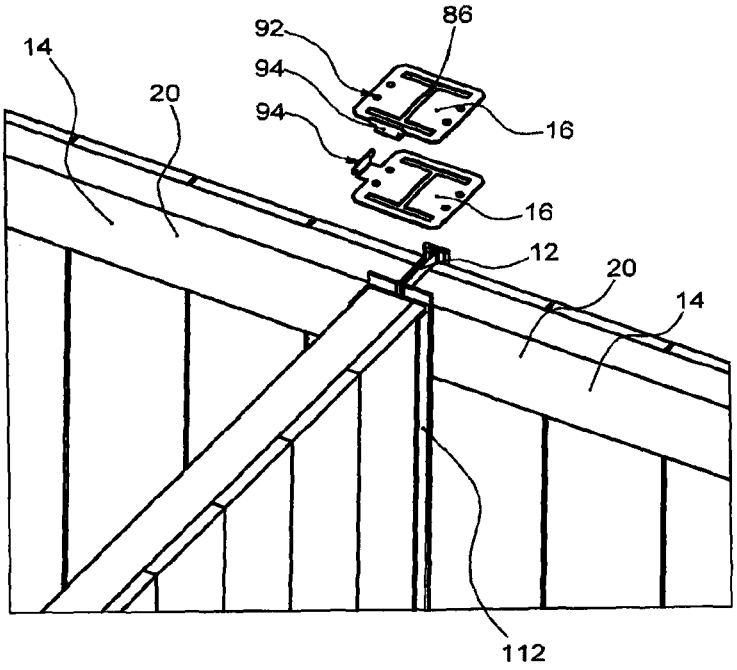
FIG. 13 shows the panel-post connector plate of FIG. 1 and a second embodiment of a panel-post connector plate in accordance with the first aspect of the invention, with perpendicularly aligned fence panels adjacent to the fence post of FIG. 1.

Referring to FIG. 13, if two fence panels 14 or rails 20 are required to be connected to the same fence post 12 at right angles or perpendicularly to each other, one may be received between the first and second surfaces 30, 32 as previously described, and one may be at or adjacent to the outside of the first or second surface 30, 32. Here a U-shaped or substantially U-shaped bracket 112 or receiver is used to receive the rail 20 or fence panel 14 at or adjacent to the outside of the first surface 30. A base of the U-shaped bracket 112 is fixed relative to the outside of the first surface 30 and two side walls 30', 32' engage the fence panel 14 or fence rail 20. The U-shaped bracket 112 preferably extends along a longitudinal extent of the fence post 12 and has fastener receiving holes 38'. Whilst described as U-shaped, the bracket is here facetted.

A second embodiment of a connector plate 16' is required to connect the header rail 26 to the fence post 12. Here the second embodiment 16' is similarly formed to the first embodiment and like reference numerals are used with a ' added. This is with the exception that the header-rail engagement member 94' extends from an edge aligned with the front or back portion of the post-receiving aperture 86', rather than with the edge aligned with a central portion. In this way, connector plates 16, 16' with engagement members 94, 94' facing in transverse directions can be stacked over the same fence post 12.

It will be appreciated that a connector plate may have a plurality of header-rail engagement members, for example it may have one header rail engagement member at or adjacent to opposing edges so as to allow connection of opposing header rails with one connector plate. Alternatively, or additionally the connector plate may have a rail engagement member at or adjacent to transversely aligned or adjacent edges. Therefore, perpendicularly aligned header rails may be interconnected by a single connector plate. The header-rail engagement member may be easily frangible from the plate body so as to enable removal of inessential header-rail engagement members.

Whilst the connector plate is described as having a post-receiving aperture, it will be appreciated that the aperture may in fact be a recess, hole or receiver.

Whilst the body of fence panels is described as being formed in situ or on site, it will be appreciated that prefabricated fence panel bodies may be used. In this instance, the rail support device is not required, although an otherwise similar or identical process as described above is used with the other features of the invention.

It is therefore possible to provide a fence post formed using a folding process which results in a fence post having an abutting double layered central web so as to provide structural integrity whilst being light and cheap to manufacture. It is also possible to provide a gravel-board retaining device to hold a gravel-board relative to a fence post via positive engagement which allows for one-person installation of the gravel board. It is further possible to provide a rail support device which has a vertical support means and lateral support means, the vertical support means being quickly and easily engageable with the fence post to hold it relative thereto. This allows for one-person installation of the rail. It is additionally possible to provide a connector plate for quick interconnection of a fence post and a header rail.

Figure 14:
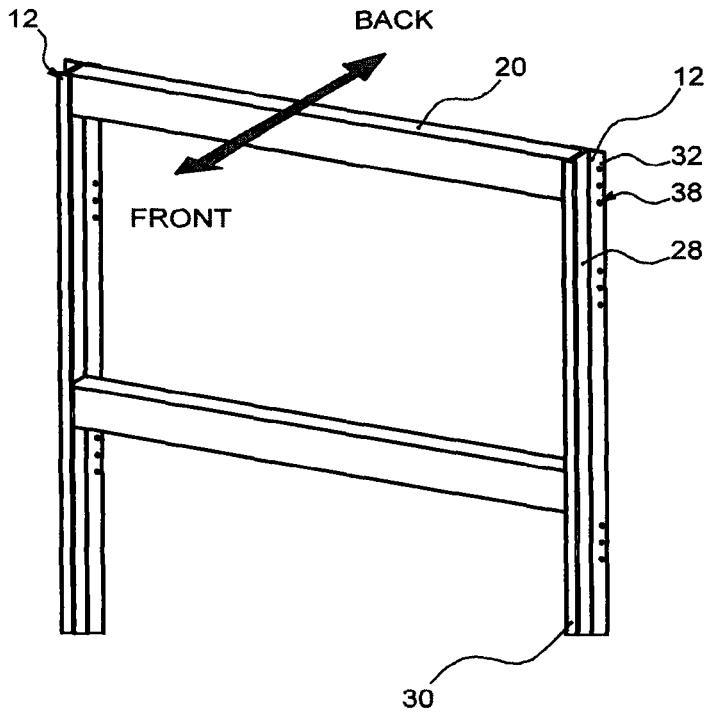
FIG. 14 shows a fence panel retained between two fence posts of FIG. 1.

FIG. 14 illustrates a fencing panel or rail 20 retained between two fence posts 12. The double layer arrangement of the central rib 28 provides strength to withstand greater forces in the front-back direction illustrated, compared to a similar fence post with only a single layer for the central rib.

Figure 15:
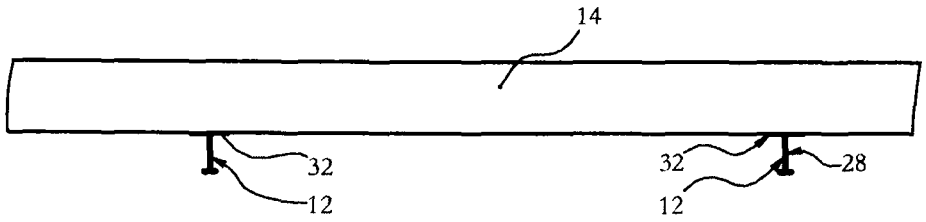
FIG. 15 shows a fence panel or rail attached to the outside of two fence posts of FIG. 1.

FIG. 15 illustrates an alternative embodiment of use, wherein a fence panel or fence rail 14 attached to the outside of two fence posts 12. It can be seen that the fence panel or fence rail 14 is attached (fixings not shown) to the outside of the second surface 32 of the fence posts 10.

Figure 16:
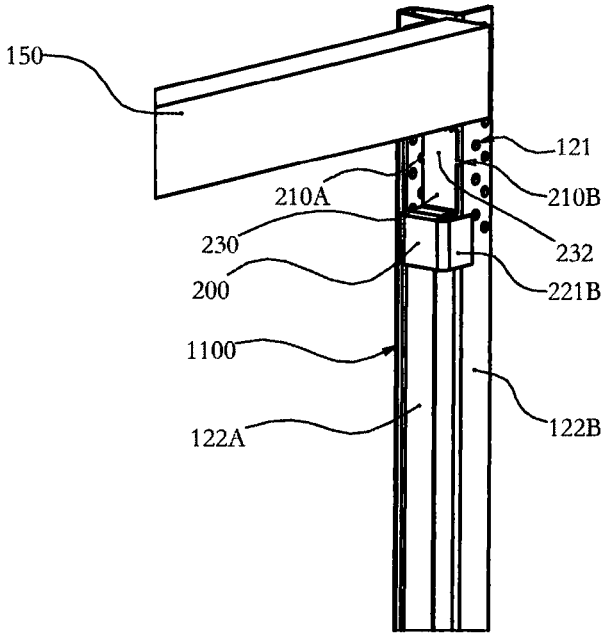
FIG. 16 shows a perspective view of part of an example fence post assembly assembled as in use, including an example holder clip attached to an example fence post, and a cross-beam mounted onto the holder clip.
Figure 17:
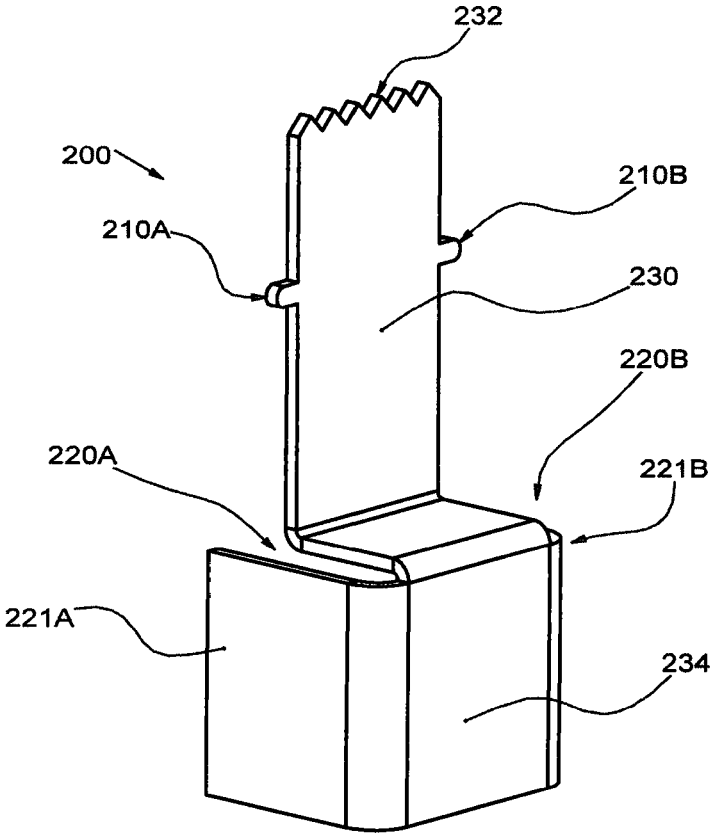
FIG. 17 shows a schematic perspective view of the example holder clip.
Figure 18:
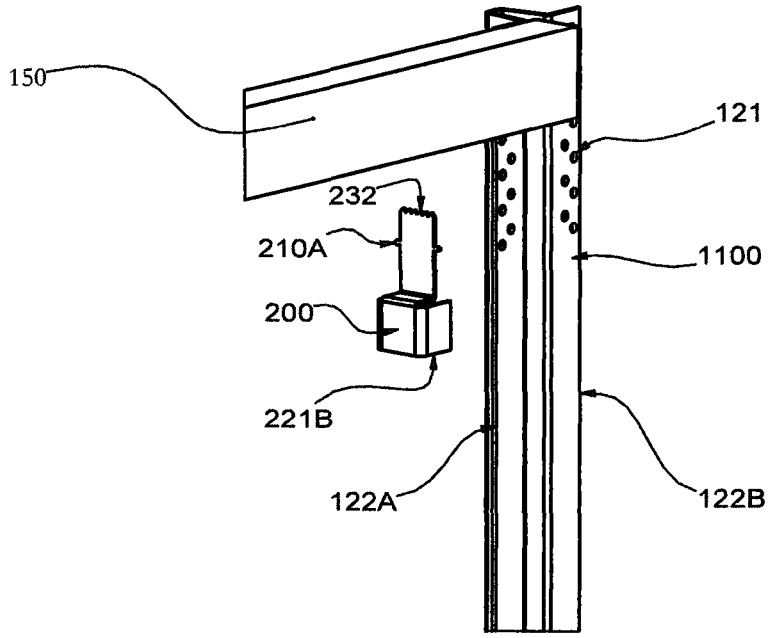
FIG. 18 shows a perspective view of part of the example fence post assembly, showing the example holder clip detached from the example fence post.
Figure 19:
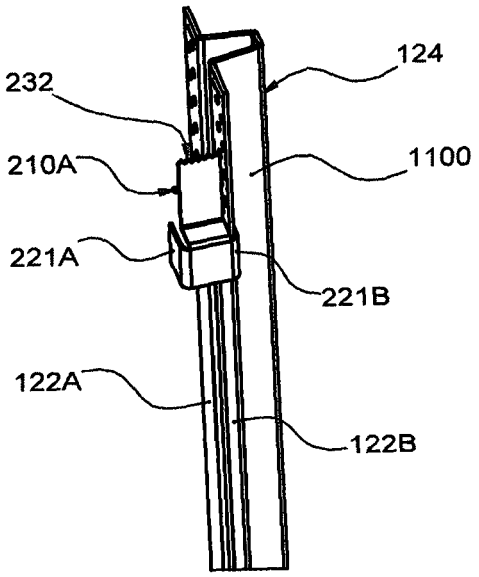
FIG. 19 shows a perspective view of part of the example fence post assembly, showing the example holder clip attached to the example fence post.
Figure 20:
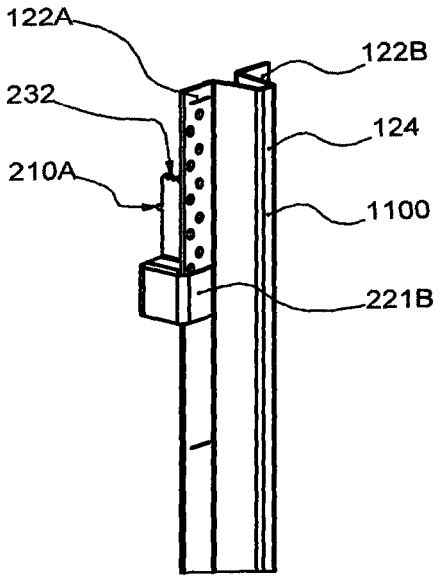
FIG. 20 shows a perspective view of part of the example fence post assembly, showing the example holder clip attached to the example fence post.
Figure 21:
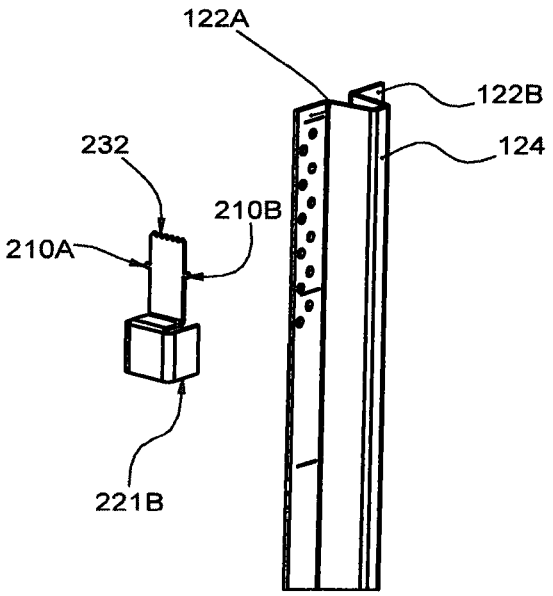
FIG. 21 shows a perspective view of part of the example fence post assembly, showing the example holder clip detached from the example fence post.
Figure 22:
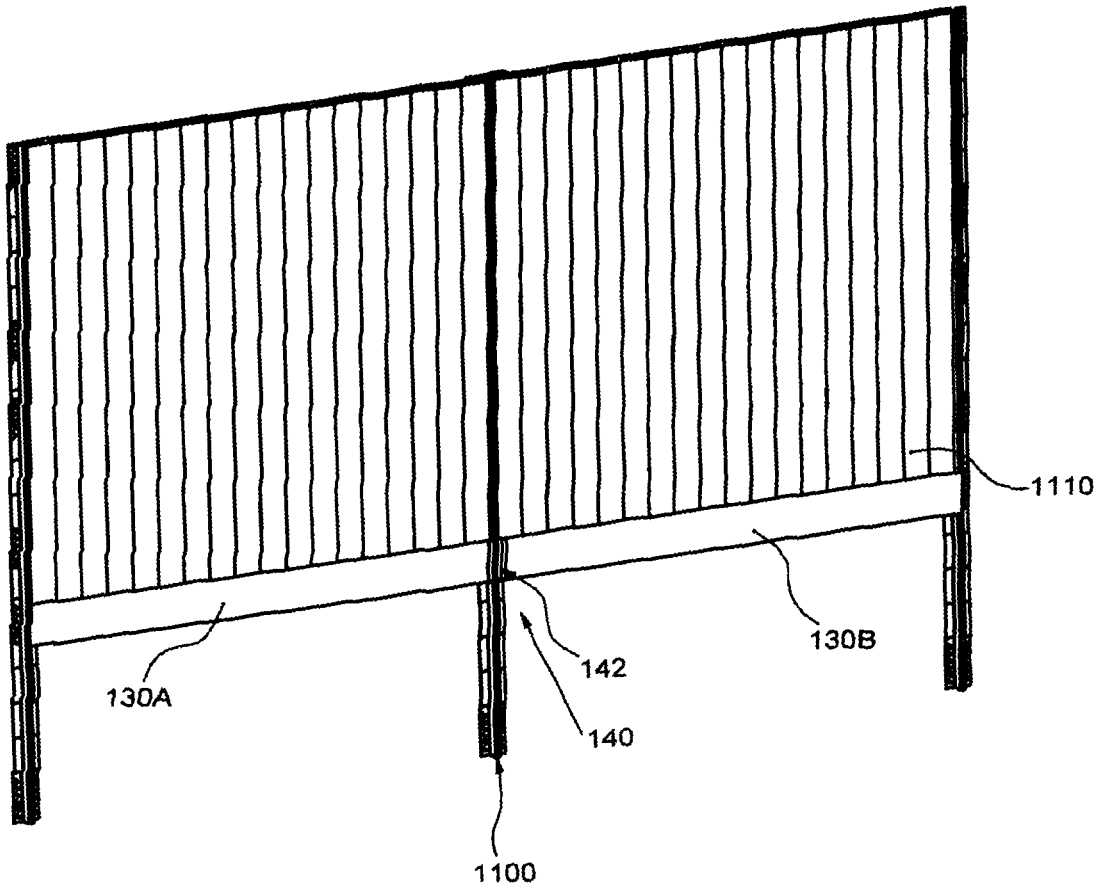
FIG. 22 shows a schematic perspective drawing of an example fence post assembly in assembled state, as part of an example fence system.
Figure 23:
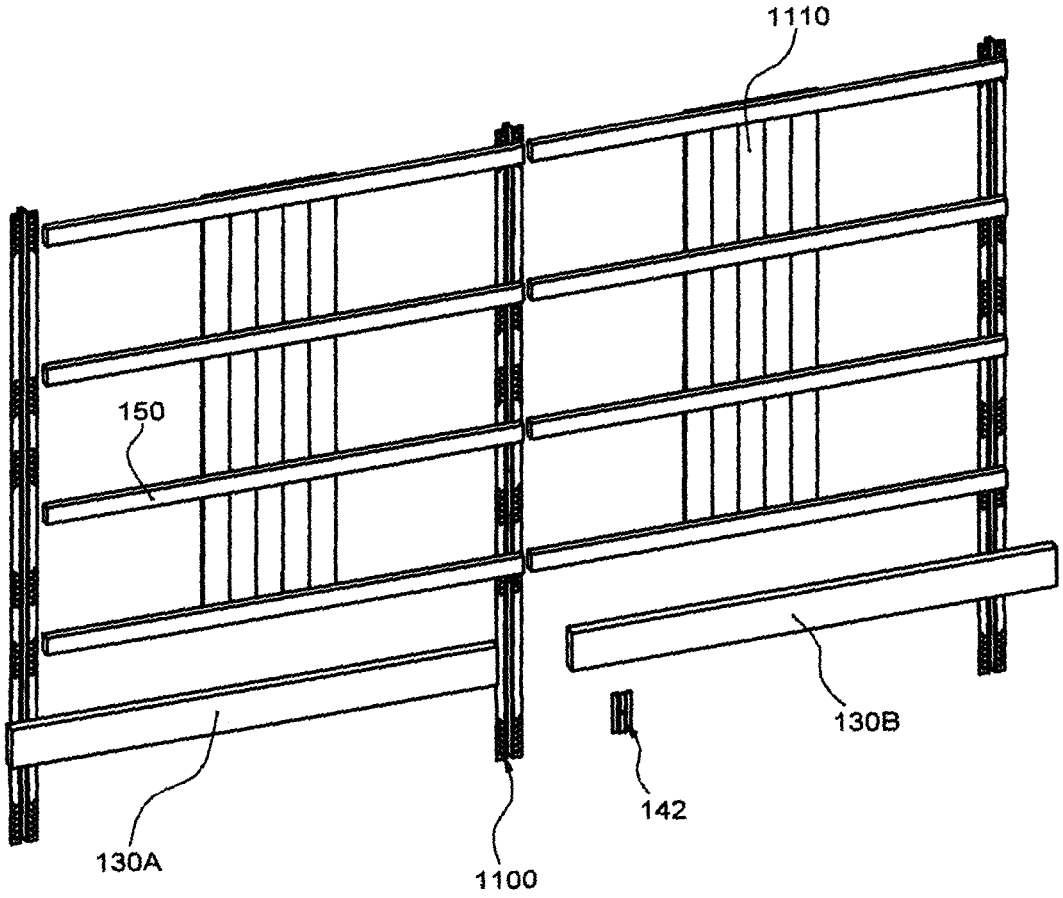
FIG. 23 shows the example fence post assembly in a partly assembled state, as part of a fence system in a partly non-assembled state.

With reference to FIGS. 16 to 21, an example fence post assembly may comprise a fence post 1100 and a holder clip 200 for supporting a cross-beam 150 temporarily, while a user fastens an end portion of the cross-beam 150 to the fence post 1100 and potentially to a neighbouring fence post (not shown). In this particular example, the holder clip 200 comprises a pair of rounded projections 210A, 210B from opposite sides of a holder body 230, and respective slots 220A, 220B formed between respective flanges 221A, 221B and a raised portion 234 of the holder body 230, the flanges bent backwards from opposite sides of the raised portion 234 to form the respective slots 220A, 220B. Each of the slots 220A, 220B is configured for receiving a flange 122A, 122B of the fence post 1100, depending on which side of the holder clip 200 is attached to a flange. The projections 210A, 210B of the holder clip 200, and the holes 121 in the fence post flanges 122A, 122B are configured such that a projection 210A, 210B can be inserted into a hole 121 to support the holder clip 200 against dropping from the fence post 1100 under gravity, particularly when loaded with the cross-beam 150. In this example, each projection 210A, 210B extends from a plate-like region of the holder body 230 and has a breadth slightly less, or substantially equal to, than the diameter of the through-holes 121, and a semi-circular end. A top bearing surface 232 is formed by an end of the of the plate-like region of the holder body 230, and includes serrations for retaining the cross-beam 150 against sliding off the bearing surface 232 when supported against it 232, as shown in FIG. 16.

When a fence system comprising the example fence post 1100 is being assembled by a user, and the user is fastening opposite end portions of the cross-beam 150 to respective neighbouring fence posts 1100 (of which one is shown in FIGS. 16 to 21), respective example holder clips 200 may be used to support each of the end portion until the cross-beam 150 has been fastened to the fence posts 1100. An example holder clip 200 can be attached to an example fence post 1100 by inserting one of the projections 210A, 210B into a hole 121 in one of the flanges 122A, 122B, and lowering the holder body 230 towards the fence post 1100 such that the slot 220A, 220B receives the flange 122A, 122B; in other words, the flange 122A, 122B is inserted into the slot 220A, 220B on the same side of the holder body 230 as the projection 210A, 210B inserted into the hole 121. The holder clip 200 can thus be stabilised against lateral movement perpendicular to the flange 122A, 122B; the combined effects of the inserted projection 210A, 210B and the slot 220A, 220B is to fasten the holder clip to the fence post 1100, so that an end portion of the cross-beam 150 can be supported on the bearing surface 232 of the holder clip 200. When the cross-beam 150 has been fastened directly to the fence post 1100, then the holder clip 200 can be detached from the fence post 1100 and reattached at a different position, for supporting a different cross-beam.

With reference to FIGS. 22 to 25, an example fence post assembly 1100 may comprise a plurality of sled fence posts 1100 and respective clamp mechanisms 140 for fastening a plurality of gravel boards 130A, 130B to the fence posts. The gravel boards 130A, 130B, which may comprise concrete, may be for spacing wooden fence panels 1110 apart from the ground (not shown) when the fence is installed. Each of the fence posts 1100 comprises a respective end portion having a sufficient length to extend substantially beyond the fence panels 1110 and the gravel boards 130A, 130B, into a base (not shown) when the fence is installed. For example, when installed, a respective end portion of each fence post 1100 may extend downwards into a respective concrete block (not shown). Respective end portions of each of the gravel boards 130A, 130B are shown fastened to the centre fence post 1100 by the clamp mechanism 140, the respective ends being spaced apart by a gap (not visible in FIGS. 22 and 23) that is covered by a clamp plate 142 of the clamp mechanism 140.

Figure 24:
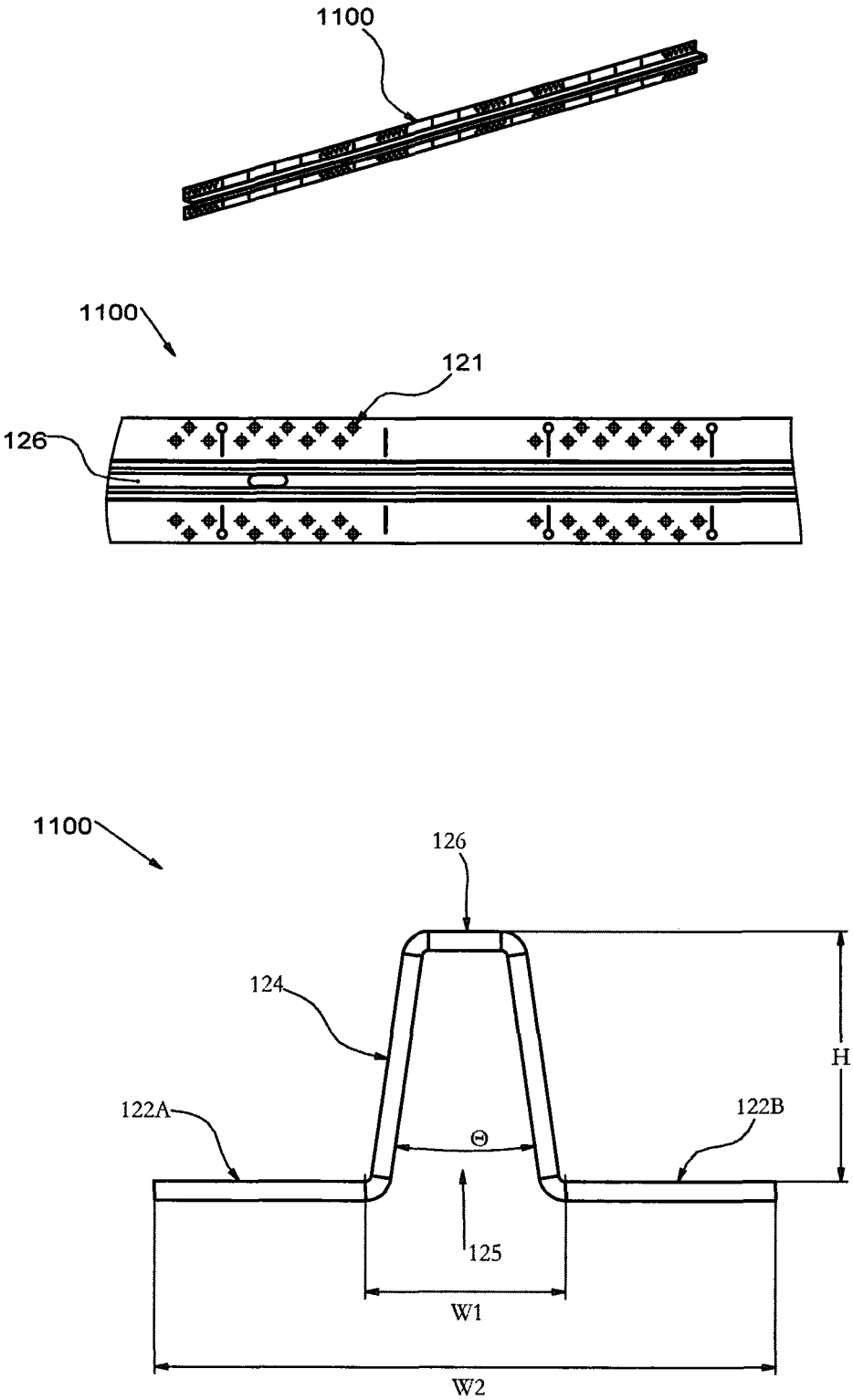
FIG. 24 shows a schematic perspective view of an example fence post (top), a top view of a portion of the example fence post (centre), and a transverse cross-section view through the example fence post (bottom)
Figure 25:
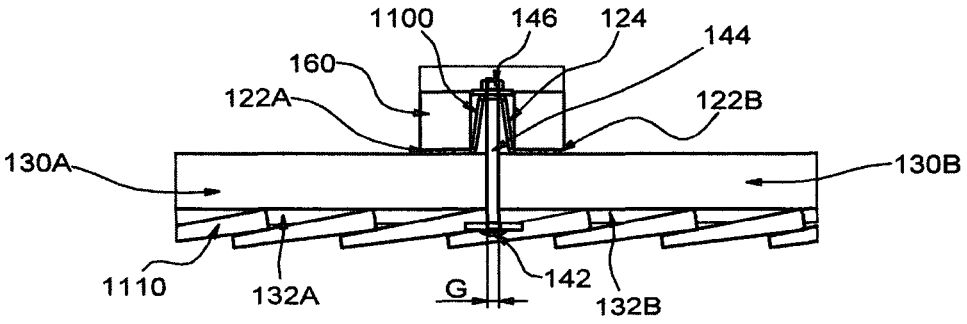
FIG. 25 shows a schematic transverse cross-section view of an example arrangement of an example clamp mechanism and fence post, including end portions of a pair of gravel boards clamped to the fence post (the view is from the ground upwards, towards a fence panel)

With particular reference to FIGS. 24 and 25, the example fence post 1100 comprises a pair of substantially coplanar flanges 122A, 122B extending laterally from a central portion 124. The central portion 124 is generally U-shaped, comprising a pair of substantially planar, inwardly-tapering side walls opposite each other, connected to each other by a substantially planar base wall, the side walls and base wall forming a boss side 126 of the central portion 124, extending away from the flanges 122A, 122B. Thus, the central portion comprises a channel formation, having a trough side 125 opposite the boss side 126. In this example, the base wall includes a through-hole (not visible in this view) for receiving a bolt (tension member) 144 of the clamp mechanism 140; and each of the flanges 122A, 122B includes two rows of holes 121 arranged longitudinally, substantially parallel to the central portion 124. The holes 121 in each row are spaced apart equidistantly, the holes 121 of one row being staggered in relation to the holes 121 of the other row, along substantially the entire length of each flange 122A, 122B.

With particular reference to FIG. 25, the example clamp mechanism 140 is fastened to the fence post 1100, clamping end portions of the gravel boards 130A, 130B to the fence post 1100. The bolt 144 of the clamp mechanism 140 has a threaded end portion inserted through the through-hole in the base wall of the central portion 124 of the fence post 1100, and fastened to the fence post 1100 by means of a nut 146 and washer. An opposite end of the bolt 144 has a bolt head and passes through a hole in the clamp plate 142, which abuts respective end areas of respective outer faces 132A, 132B of each gravel board 130A, 130B. As the nut 146 is tightened, the respective end portion of each gravel board 130A, 130B is clamped by the clamp plate 142 against a front surface of a respective flange 122A, 122B of the fence post 1100, placing the bolt 144 in tension. The respective ends of each gravel hoard 130A, 130B are spaced apart by a gap G, which is covered and substantially concealed by the clamp plate 142. In this particular example, the fence post 1100 is located on one side of the gravel boards 130A, 130B; it may be said that the gravel boards 130A, 130B are placed in front of the fence post 1100, the central portion 124 of the fence post 1100 extending away from a rear side of the gravel boards 130A, 130B, and the apex surface 126 of the fence post 1100 being remote from the gravel boards 130A, 130B. In this particular example arrangement, an elongate wooden cover 160 is positioned over the central portion 124 of the fence post 1100 and against the rear surfaces of the flanges 122A, 122B of the fence post 1100, to substantially conceal most of the fence post 1100. A bottom end of the fence panel 1110, comprising a plurality of wooden boards, will be spaced apart from the ground by the gravel boards 130A, 130B, and is visible in FIG. 25.

Figure 26:
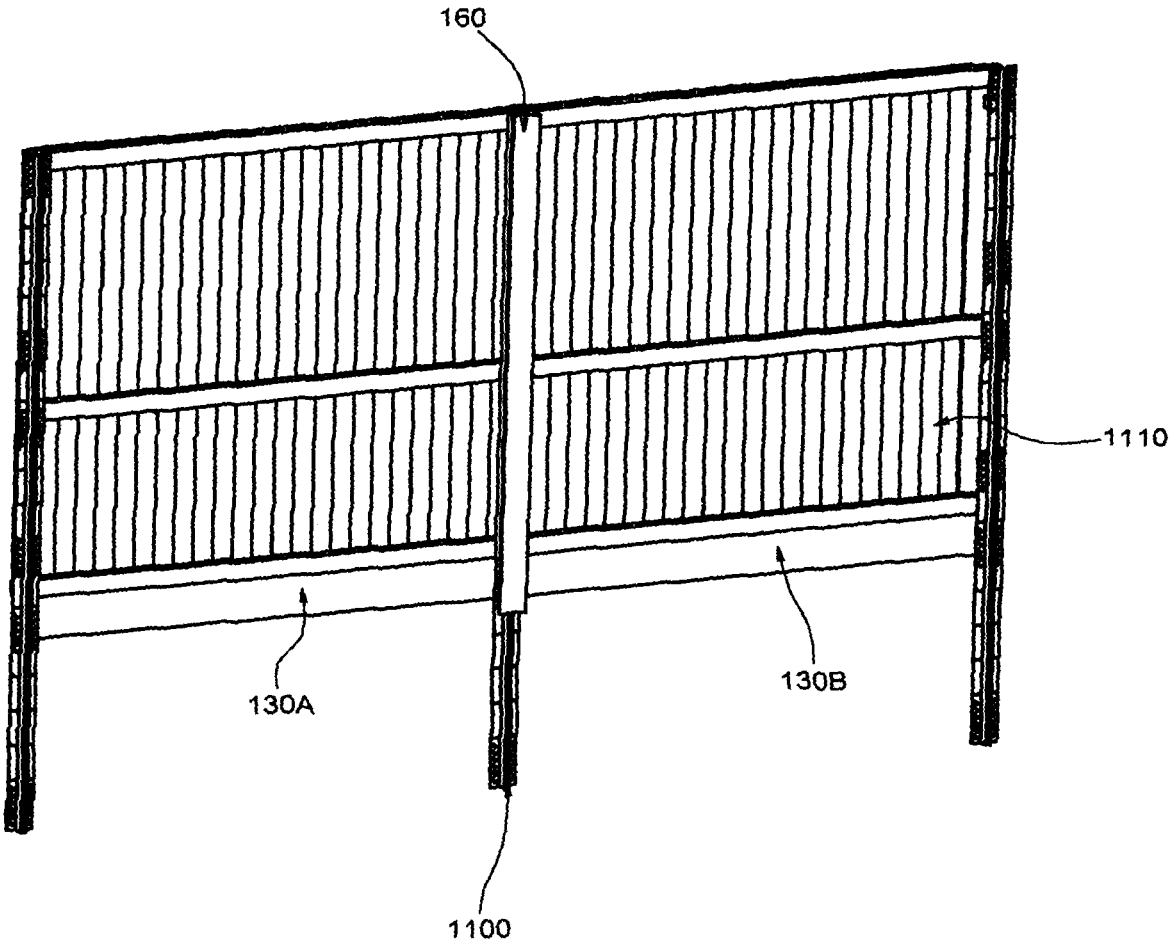
FIG. 26 shows a schematic perspective view of an example fence post assembly in assembled state, as part of an assembled fence system.
Figure 27:
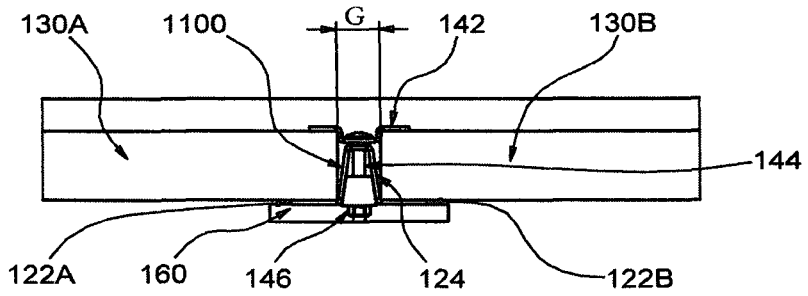
FIG. 27 shows a schematic transverse cross-section view of an example arrangement of an example clamp mechanism and fence post, including end portions of a pair of gravel boards clamped to the fence post (the view is from the ground upwards, towards a fence panel)
Figure 28:
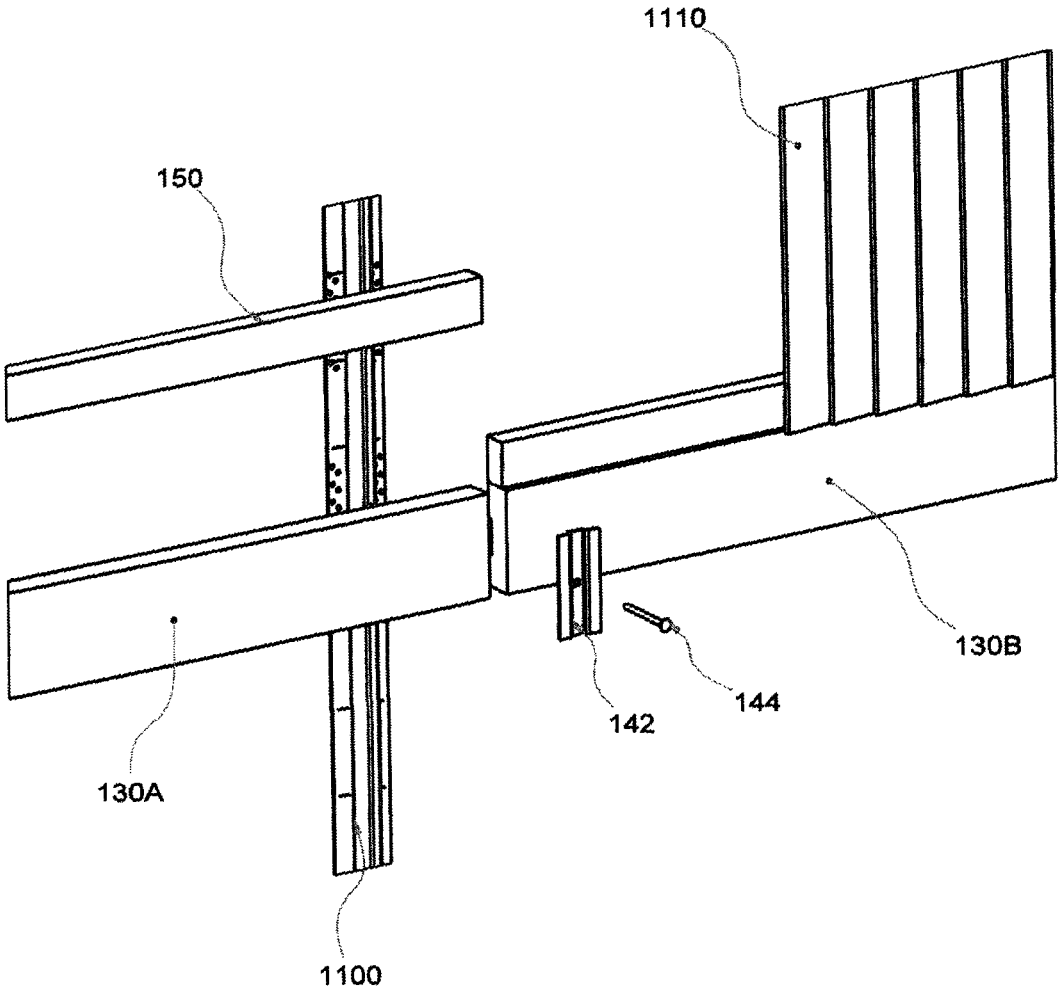
FIG. 28 shows a magnified exploded schematic perspective view of an example arrangement of the clamp mechanism and fence post, including end portions of a pair of gravel boards, a cross-beam and fence panels.

FIGS. 26 to 28 illustrate another example arrangement of the fence post assembly, in which the respective end portions of each gravel board 130A, 130B are clamped to the rear surface of the respective flanges 120A, 120B, so that the central portion 124 of the fence post intrudes directly between the ends of the gravel boards 130A, 130B, which are spaced apart by a gap G. In this particular example, the clamp plate 142 includes a pair of flanges extending from a central portion, the respective flanges being clamped against respective end surface portions of each gravel board 130A, 130B, and the central portion intruding between the ends of the gravel boards 130A, 130B. In this example arrangement, the boss side 126 of the central portion of the fence post 1100 faces towards the clamp plate 142, intruding into the gap G between the ends of the gravel boards 130A, 130B. A wooden cover 160 can be placed against the front surfaces of the flanges 122A, 122B of the fence post 1100 to substantially conceal the fence post 1100 from a front view.

Figure 29:
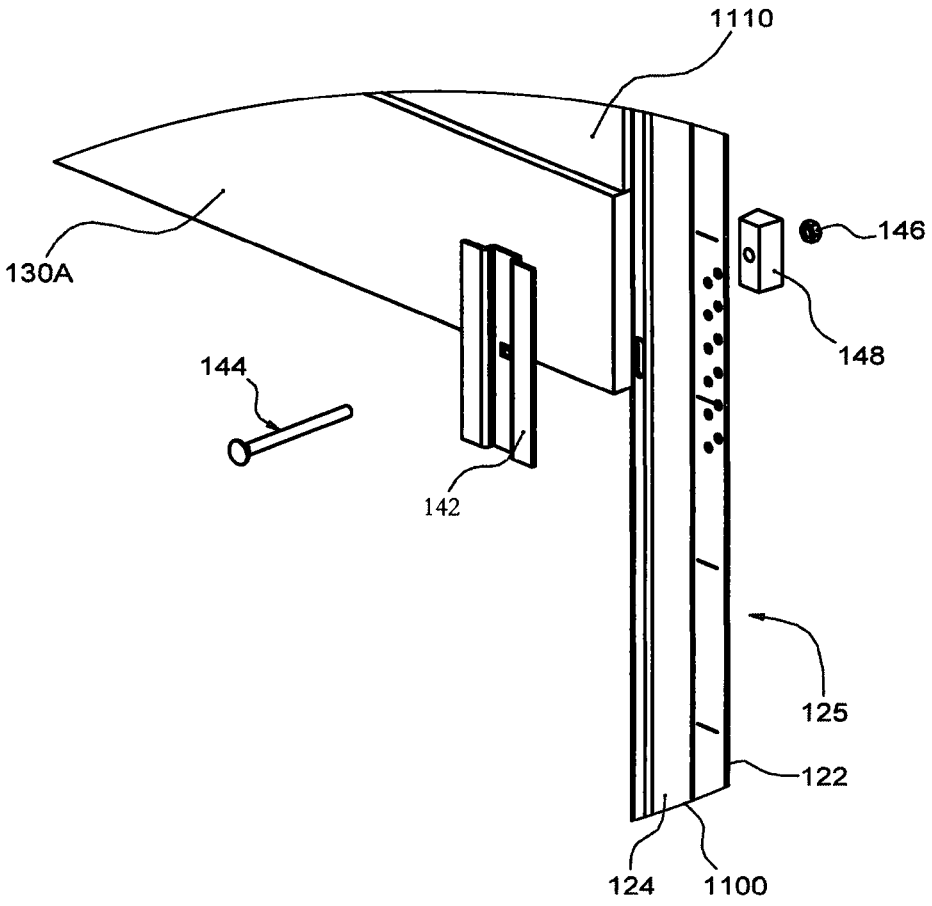
FIG. 29 shows an exploded schematic perspective view of an example arrangement of a clamp mechanism and fence post, including an end portion of a gravel board and part of a fence panel.
Figure 30:
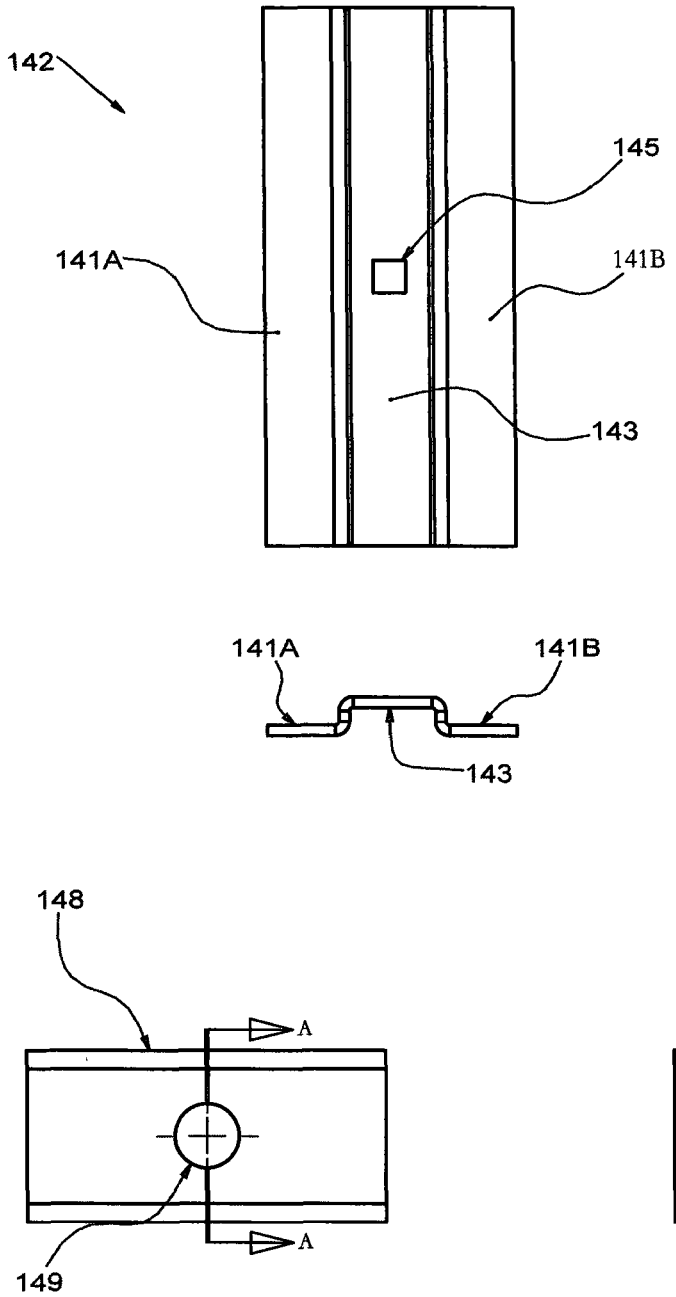
FIG. 30 shows a schematic top view of an example clamp plate (top), a transverse cross-section through the example clamp plate (centre), and top and longitudinal cross-section views of an example clamp block (bottom)
Figure 31:
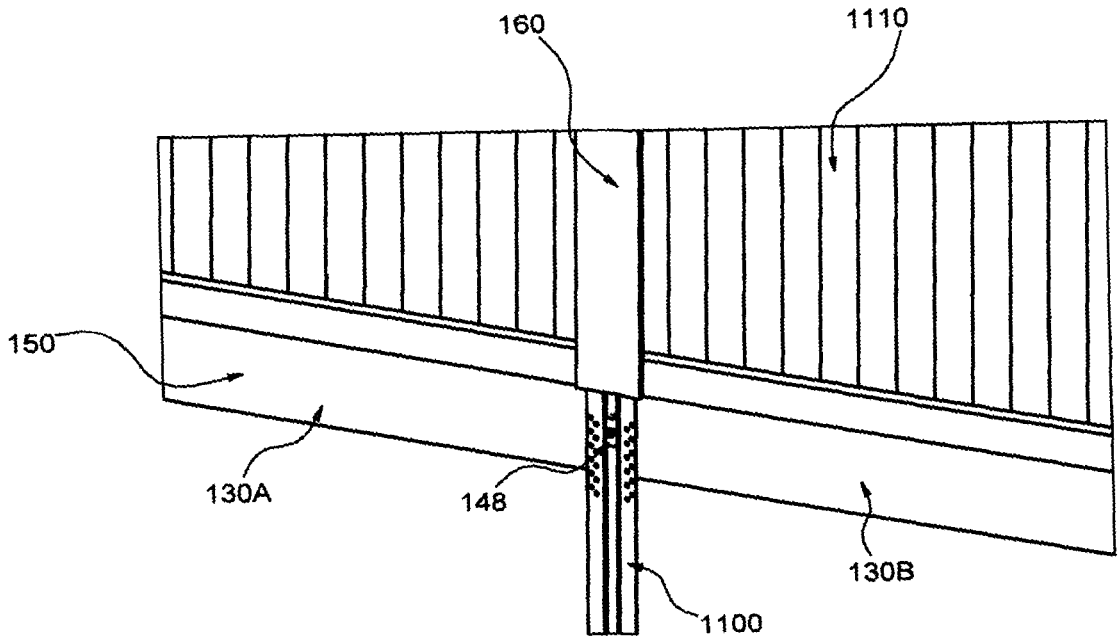
FIG. 31 shows a schematic perspective view of part of an example fence post assembly, assembled as in use, as part of an assembled fence system.

FIGS. 29 to 4C illustrate another example arrangement of an example fence post assembly, in which the clamp mechanism comprises a clamp plate 142, a bolt 144, a nut 146 and a clamp block 148. With particular reference to FIG. 30, the example clamp plate 142 may comprise a pair of substantially coplanar flanges 141A, 141B extending laterally from a central portion 143, which includes a central through-hole 145 for receiving the bolt 144. In this particular example, the clamp plate 142 includes a generally U-shaped channel having a substantially planar base wall that is elevated from the plane of the flanges 141A, 141B by side walls. The clamp block 148 includes a through-hole 149 for receiving an end portion of the bolt 144, and has tapered sides, configured for fitting into the trough side of the central portion of the example fence post 1100.

With particular reference to FIG. 29, the central portion 143 of the clamp plate 142 and the central portion 124 of the fence post 1100 can each be inserted into the gap between the ends of the gravel boards 130A, 130B (as illustrated in FIG. 27), of which only 130A is shown in FIG. 29. The clamp block 148 can be inserted in the trough side 125 of the fence post 1100, the through-hole in the base wall of the central portion 143 of the clamp plate 142, being axially aligned with the hole in the clamp block 148 so that the bolt 144 can pass through both, and the nut 146 fastened to the threaded end portion of the bolt 144. Thus, the gravel boards 130A, 130B can be clamped to rear surfaces of the fence post flanges 122A, 122B, the bolt 144 being in tension and the clamp block 148 being in compression.

Figure 32:
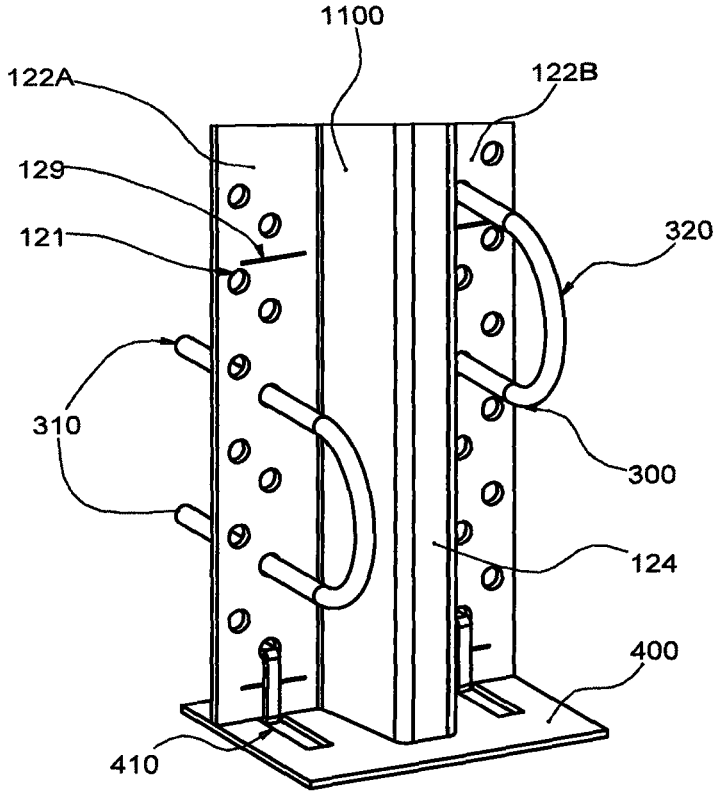
FIG. 32 shows a schematic perspective view of an end portion of an example fence post assembly, including two example U-shaped reinforcement bars and an example stabilisation plate, attached to the end of the fence post as in use.
Figure 33:
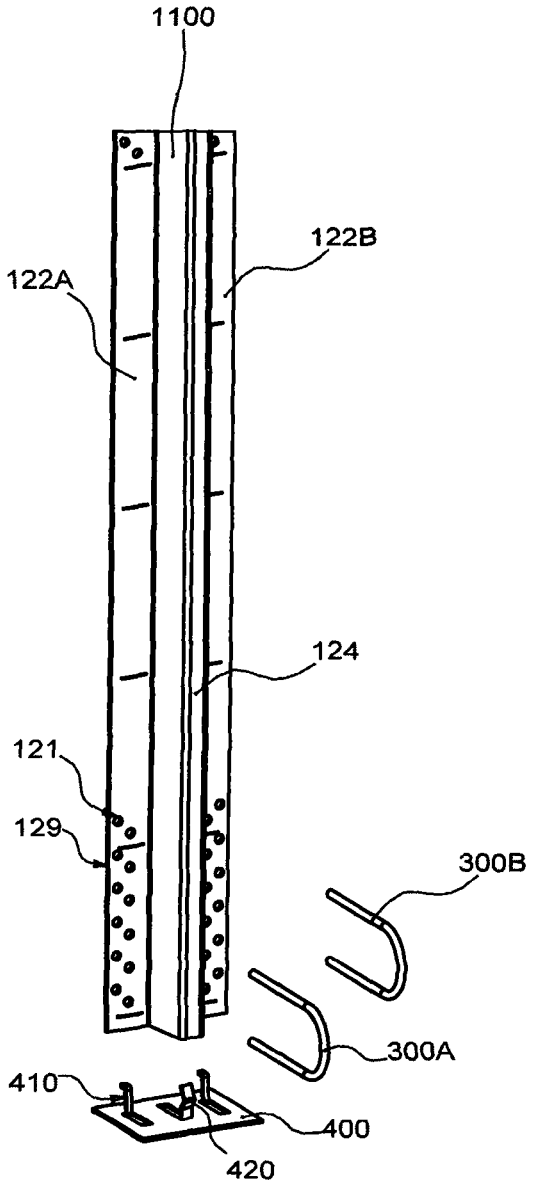
FIG. 33 shows a schematic perspective view of an end portion of the example fence post assembly, showing the example reinforcement bars and stabilisation plate non-attached.
Figure 34:
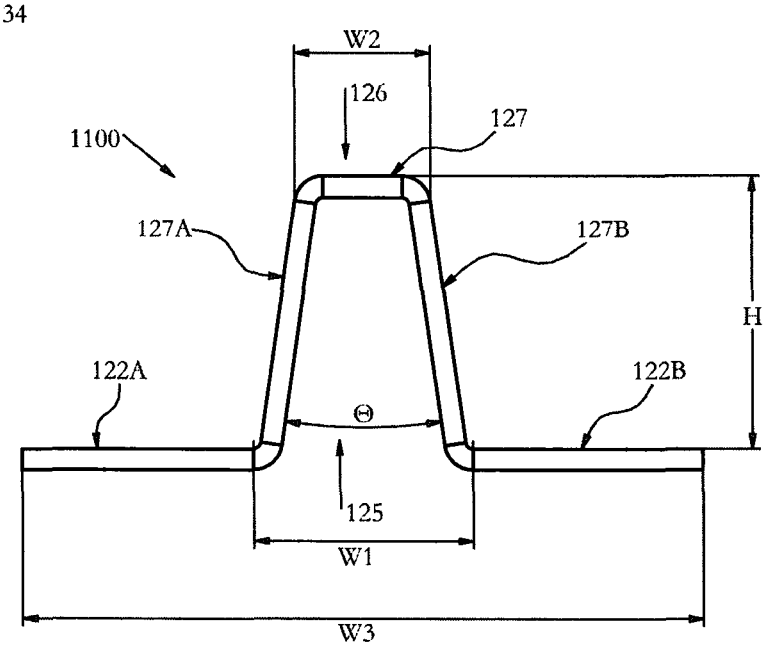
FIG. 34 shows a schematic transverse cross-section view of an example fence post.
Figure 35:
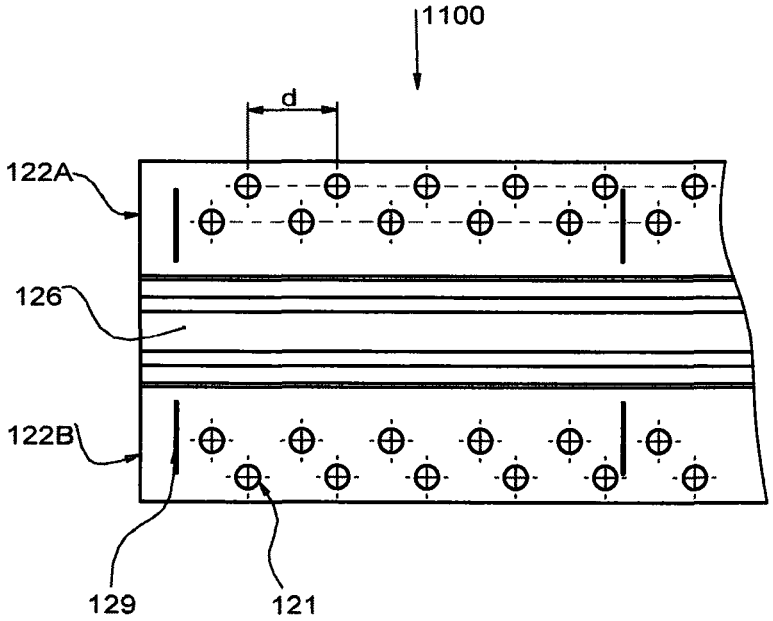
FIG. 35 shows a schematic top view of an end portion of an example fence post.

With reference to FIGS. 32 and 33, an example fence post assembly comprises a fence post 1100, two reinforcement U-bars 300, and a stabilising end-plate 400. A proximal end portion of the fence post 1100 is shown, comprising a pair of substantially coplanar flanges 122A, 122B extending laterally from opposite sides of a central portion 124 of the fence post 1100. In this example, the central portion 124 is formed as a channel structure, having a trough side and an opposite boss side, and both flanges may extend along the entire length of the fence post 1100. In this example, a plurality of markings 129 on the fence post 1100 may indicate the axial position along the fence post 1100. Each of the flanges 122A, 122 includes two columns of staggered through-holes 121, the through-holes in each column being substantially equidistant from each other and extending to proximate the end of the fence post 1100. Each U-bar 300 may consist essentially of steel for reinforcing concrete, and have a pair of parallel arms 310 connected by an arcuate portion 320, each configured for insertion in a through-hole 121 in a flange 122A, 122B. The end-plate 400 can be attached to the proximal end of the fence post 1100 by means of brackets 410.

When a fence is being installed, a respective hole may be prepared in the ground (not shown) for installing each fence post 1100, and the respective end portion of each fence post 1100 can be inserted into the hole, the U-bars 300 inserted into through-holes 121 in the end portion, and the end-plate 400 fastened to the proximal end of the fence post 1100. Wet concrete or cement, or other suitable material in fluid form that is capable of setting to provide a solid base, can be poured into the hole, enveloping the end portion, the U-bars 300 and the end-plate 400. The end-plates 400 may stabilise the fence post 1100 against sinking or tilting into soft ground while the wet concrete or cement is wet, and the U-bars 300 may reinforce the concrete or cement once it has dried and set.

With reference to FIGS. 34 to 37, example fence posts 1100 comprises a pair of substantially coplanar flanges 122A, 122B extending from a central portion 124, which comprises a channel structure having a trough side 125 and an opposite boss side 126. In the particular example illustrated, each flange 122A, 122B includes two rows of through-holes 121, equally spaced apart from each other in each row by a spacing d of about 25 mm, each through-hole having a diameter of about 6.5 mm. The central portion 124 has planar side walls 127A, 127B connecting each flange 122A, 122B with a base wall 127, the side walls 127A, 127B tapering inwards, defining an included angle Θ of about 16° between themselves. The spacing W1 between the inner boundaries of the flanges 122A, 122B may be about 43 mm, the width W2 of the base wall 127 may be about 31 mm, and the perpendicular spacing H between the plane of the base wall 127 and the plane of the flanges 122A, 122B be about 45 mm (the base wall 127 being substantially parallel with the flanges 122A, 122B). The spacing W3 between the outer edges of the flanges 122A, 122B may be about 90 mm, and in this example, the flanges 122A, 122B, the side walls and 127A, 127B and the base wall have substantially the same thickness of about 3 mm.

In another example, the spacing W1 between the inner boundaries of the flanges 122A, 122B may be about 23.6 mm, the width W2 of the base wall 127 may be about 20 mm, and the base wall 127 may be laterally spaced apart from the plane of the flanges 122A, 122B by about 38 mm (the base wall 127 being substantially parallel with the flanges 122A, 122B). The spacing W3 between outer edges of the flanges 122A, 122B may be about 95 mm.

Figure 36:
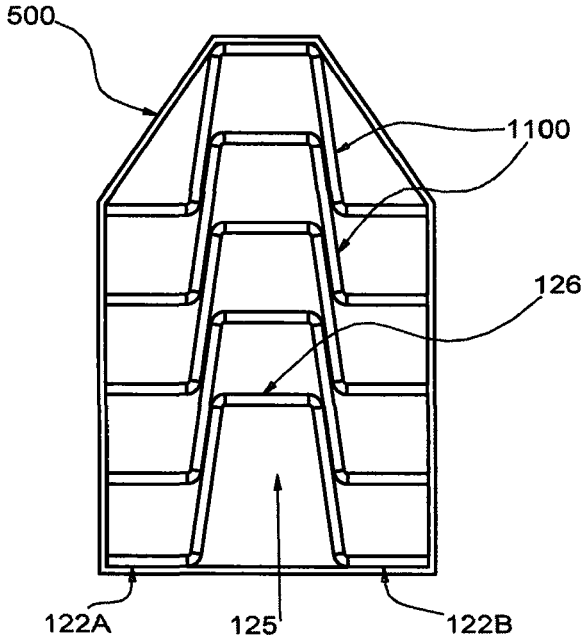
FIG. 36 shows a schematic transverse cross-section view of a single stack of five example fence posts.
Figure 37:
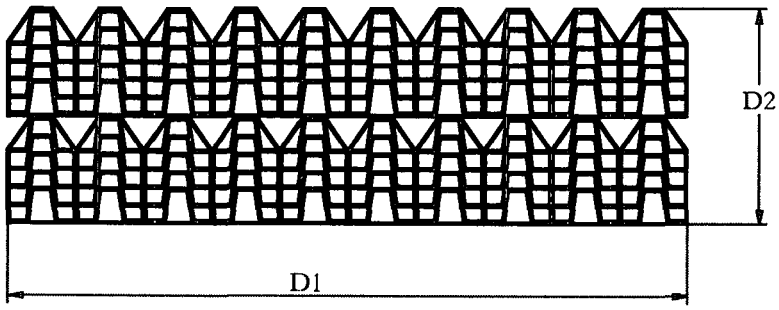
FIG. 37 shows a schematic transverse cross-section view of multiple stacks of example fence posts, arranged for storage or transport.

With reference to FIGS. 36 and 37, example fence posts 1100 can be stacked on top of one another for storage and transport, bound by a wrapper 500. The shape and dimensions of the fence posts 1100 allow the boss sides 126 of the respective central portions 124 to be inserted into the trough sides 125 of adjacent fence posts 1100 in the stack. The stacks may be further packed into pallets as illustrated in FIG. 37, each pallet containing a total of 100 fence posts 1100, for example. Each pallet may have a width D1 of about 949 mm and a height D2 of about 300 mm.

Some example fence assemblies may have the aspect of enabling the spacer beams (gravel boards) to be fastened to the fence post with greater easy and speed.

Some example fence assemblies may have the aspect that cross-beams can be more easily installed, including by a single user, since each end of the cross-beam can be supported by a respective holder clip attached to respective fence posts, thus holding the cross-beam in position while the user fastens each end to the respective fence post by means of respective fasteners. For example, the fastener may comprise a bolt or tension member that can be inserted into, or through, a hole in the fence post.

In some example arrangements, the fence post assembly may have the aspect of being easy and efficient to store and transport, requiring relatively little storage space, since the fence posts in some examples can be easily stacked against one another in an inter-engaging arrangement. In addition, steel posts may be substantially less bulky and/or heavy than certain kinds of wooden or concrete posts.

As used herein, an assembly of items may comprise the items assembled as in use, or in a non-assembled state, such as in kit form.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A panel-post connector plate configured to in use connect a fence post to an adjacent fence panel having a panel body and a header rail, the panel-post connector plate comprising:

a plate body having a post-receiving aperture with an H-shaped cross-section, the plate body configured to in use receive at least part of the fence post therethrough, and a fastener receiving aperture configured to in use receive a fastener to attach the plate body to the panel body of the adjacent fence panel; and a header-rail engagement member at or adjacent to the plate body, the header-rail engagement member at least in part upstanding from a plane defined by the plate body and configured to be in use received in the in-use header rail of the in-use adjacent fence panel, wherein the H-shaped cross-section of the post-receiving aperture includes first and second openings that are connected by a third opening, wherein the first opening is configured to receive a first part of a fence post that is thicker than a second part of the fence post received by the second opening, and wherein the second opening has a width that is different than a thickness of the second part of the fence post received by the width of the second opening.

2. The panel-post connector plate as claimed in claim 1, wherein the header-rail engagement member has a stop configured to in use prevent or limit uplift of the in-use header rail relative to the panel-post connector plate.

3. The panel-post connector plate as claimed in claim 2, wherein the header-rail engagement member has two said stops, each stop at an opposing lateral edge of the header-rail engagement member configured to in use prevent uplift of the in-use header rail at each lateral edge.

4. The panel-post connector plate as claimed in claim 1, wherein the header-rail engagement member has a uniform lateral cross-section so as to be configured to be slidably received in the in-use header rail.

5. The panel-post connector plate as claimed in claim 1, wherein the header-rail engagement member extends from an edge of the plate body.

6. The panel-post connector plate as claimed in claim 5, wherein the header-rail engagement member includes a tongue to space an upstanding portion of the header-rail engagement member from the edge of the plate body.

7. The panel-post connector plate as claimed in claim 1, wherein the post-receiving aperture is arranged so as to receive the fence post in a plurality of orientations.

8. The panel-post connector plate as claimed in claim 1, wherein a plurality of panel-post connector plates is configured to be stacked.

9. The panel-post connector plate as claimed in claim 1, wherein the plate body has a plurality of sides with at least one said fastener receiving aperture at or adjacent thereto.

10. A fence comprising a fence post formed from metal folded into a generally H-shaped cross-section, the fence post comprising:

a central rib that extends longitudinally along a length of the fence post and first and second opposing, and substantially planar, surfaces that extend laterally from the central rib, wherein the central rib and the first surface each comprises a double layer of metal, each layer of each said double layer abutting or substantially abutting each other, and wherein the second surface comprises a single layer of metal, and fixing holes for attaching fencing material to the fence post in use.

11. The fence post as claimed in claim 10, wherein the fence post is formed from cold-rolled metal.

12. The fence post as claimed in claim 10, wherein the first surface is narrower than the second surface.

13. The fence post as claimed in claim 10, wherein the metal is folded such that there are essentially no voids between abutting surfaces.

14. The fence post as claimed in claim 10, wherein the fixing holes are positioned on the second surface while the first surface is holeless.

15. The fence post as claimed in claim 10, wherein:

the first surface is holeless, and the fixing holes are positioned on the second surface at a distance from the central rib that is larger than a length extending from the central rib to an end of the first surface.

16. A fence system comprising:

at least one fence post wherein each of the each of the at least one fence post is formed from metal folded into a generally H-shaped cross-section, each of the at least one fence post comprising:

a central rib that extends longitudinally along a length of the fence post and first and second opposing, and substantially planar, surfaces that extend laterally from the central rib, wherein the central rib comprises a double layer of metal, each layer of the double layer abutting or substantially abutting each other, fixing holes positioned on the second surface and configured to attach fencing material to the fence post in use;

at least one fence panel connected to the fence post via a panel-post connector plate; and the panel-post connector plate comprising:

a plate body having a post-receiving aperture configured to in use receive at least part of the fence post therethrough, and a fastener receiving aperture configured to in use receive a fastener to attach the plate body to a panel body of an adjacent fence panel, and a header-rail engagement member at or adjacent to the plate body, the header-rail engagement member at least in part upstanding from a plane defined by the plate body and configured to be in use received in the in-use header rail of the in-use adjacent fence panel.

* * * * *